US010414529B1

(12) United States Patent
Bayer

(10) Patent No.: US 10,414,529 B1
(45) Date of Patent: Sep. 17, 2019

(54) MACHINES AND COMPONENTS FOR GENERATING BEVERAGE PODS FOR USE IN SINGLE SERVE BEVERAGE BREWING MACHINES

(71) Applicant: William S. Bayer, North Vancouver (CA)

(72) Inventor: William S. Bayer, North Vancouver (CA)

( * ) Notice: Subject to any disclaimer, the term of this patent is extended or adjusted under 35 U.S.C. 154(b) by 0 days.

(21) Appl. No.: 15/955,486

(22) Filed: Apr. 17, 2018

(51) Int. Cl.

| | |
|---|---|
| ***B65D 85/804*** | (2006.01) |
| ***B65B 1/06*** | (2006.01) |
| ***B65B 1/36*** | (2006.01) |
| ***B65B 7/28*** | (2006.01) |
| ***B65B 29/02*** | (2006.01) |
| ***B65B 43/44*** | (2006.01) |
| ***B65B 43/52*** | (2006.01) |

(52) U.S. Cl.
CPC ..... *B65B 29/022* (2017.08); *B65B 1/06* (2013.01); *B65B 1/36* (2013.01); *B65B 7/2807* (2013.01); *B65B 43/44* (2013.01); *B65B 43/52* (2013.01); *B65D 85/8043* (2013.01)

(58) Field of Classification Search
CPC ..... B65B 1/06; B65B 1/36; B65B 7/2807; B65B 7/2842; B65B 7/285; B65B 29/02; B65B 29/022; B65B 29/025; B65B 43/44; B65B 43/52
USPC ..... 53/281–283, 284.5, 300, 313–316
See application file for complete search history.

(56) References Cited

U.S. PATENT DOCUMENTS 2,341,126 A * 2/1944 Stover ..... B67B 3/02 221/290
2,352,764 A * 7/1944 Bell ..... B67B 3/062 221/297
2,840,963 A * 7/1958 Osmond ..... B65B 7/2807 221/222
3,220,445 A * 11/1965 Taisey ..... B65B 39/12 141/105
3,293,823 A * 12/1966 Anderson ..... B65B 7/2807 53/131.4
3,460,314 A * 8/1969 Keas ..... B65B 7/2807 493/109

(Continued)

FOREIGN PATENT DOCUMENTS

AT 505545 A4 * 2/2009 ..... B65B 1/36
CA 2046558 1/1992

(Continued)

OTHER PUBLICATIONS

Hasa, "Difference Between Coffee Pods and Capsules," May 25, 2016, Pediaa.Com, copyright 2017, 7 pages.*

*Primary Examiner* — Stephen F. Gerrity
(74) *Attorney, Agent, or Firm* — Thomas Horstemeyer, LLP

(57) ABSTRACT

Various examples are provided for beverage pods, and beverage pod filling machines configured to fill such beverage pods with beverage material, wherein such machines are configured to have a small footprint, such that the filling machines can be provided for use in a home or office setting, for example. Examples of beverage pod components that can be filled with beverage materials and lidding systems therefore are also provided, where the combination of container and lids provides a beverage pod having beverage material therein for use in single serve brewing systems.

21 Claims, 30 Drawing Sheets

(56) References Cited

U.S. PATENT DOCUMENTS 3,503,182 A * 3/1970 Phipps ..... B65B 7/2807 53/282
3,712,021 A * 1/1973 Logemann et al. .... B65B 7/285 53/329
3,899,102 A * 8/1975 Lack et al. ..... B65B 43/44 221/223
3,906,703 A * 9/1975 Heisler ..... B65B 7/2807 221/221
3,932,978 A * 1/1976 Kinney ..... B65B 43/44 53/471
4,024,694 A * 5/1977 Cooper et al. ..... B65B 1/02 53/131.3
4,285,187 A * 8/1981 Schjeldahl ..... B65B 43/59 198/748
4,779,748 A * 10/1988 King ..... B65B 7/2807 215/256
4,979,347 A * 12/1990 Shibauchi et al. ..... B65B 55/04 198/733
5,050,367 A * 9/1991 Heisler ..... B65B 7/2807 53/313
5,067,308 A * 11/1991 Ward ..... B65B 43/44 221/223
5,791,127 A * 8/1998 Rossi ..... B65B 29/02 53/202
5,931,341 A * 8/1999 Bittermann ..... B65B 7/2807 221/222
6,219,996 B1 * 4/2001 Searle ..... B65B 7/2807 141/125
6,418,701 B1 * 7/2002 Navarro ..... B65B 7/2807 221/223
7,392,636 B2 7/2008 Conti
7,614,205 B2 11/2009 Conti
7,661,248 B2 2/2010 Conti
7,730,697 B2 6/2010 Bernardi et al.
9,108,794 B2 8/2015 Fu et al.
9,527,661 B2 12/2016 Fu et al.
9,629,494 B2 4/2017 Fu et al.
9,743,798 B2 8/2017 Fu et al.
2014/0352254 A1 12/2014 Rea
2015/0107197 A1 * 4/2015 Plessner et al. ..... B65B 7/2807 53/485
2015/0225099 A1 8/2015 Villain et al.
2016/0176555 A1 6/2016 Castellari
2016/0214747 A1 * 7/2016 Carisi et al. ..... B65B 29/02
2016/0264348 A1 9/2016 Camera et al.
2016/0347483 A1 12/2016 Rea et al.
2017/0174418 A1 6/2017 Cai
2017/0210498 A1 7/2017 Jenkins et al.
2017/0259989 A1 9/2017 Trombetta et al.

FOREIGN PATENT DOCUMENTS

CH 507838 A * 5/1971 ..... B65B 7/2807
DE 102004044846 A1 * 3/2006 ..... B65B 59/04
DE 102014203789 A1 * 9/2015 ..... B65B 29/02
FR 2681835 A1 * 4/1993 ..... B65B 43/44
GB 419239 A * 11/1934 ..... B65B 7/2807
WO WO-2018025136 A1 * 2/2018 ..... B65B 29/02

* cited by examiner

MACHINES AND COMPONENTS FOR GENERATING BEVERAGE PODS FOR USE IN SINGLE SERVE BEVERAGE BREWING MACHINES

FIELD OF THE DISCLOSURE

The present disclosure relates to machines configured to fill beverage pods with beverage material. Such machines can be configured to have a small footprint, for use in a home or office setting, for example. The present disclosure also relates to beverage pod components that can be filled with beverage materials and lidding systems therefore, where the combination of pods and lids provides a beverage pod to be fillable with beverage material therein for use in single serve brewing systems.

BACKGROUND

In recent years an abundance of single-serve hot beverage brewing machines have been marketed to home and business beverage consumers as a quick and convenient manner of brewing a selected beverage material. Most commonly, such machines dispense coffee, tea, cocoa or soup by dispensing hot water through the beverage pod, where the pods are configured with the desired beverage material. The user will select the desired beverage material by way of a filled and lidded beverage pod, and insert the pod into a cavity configured within the brewer. In some configurations, upon closure of the pod in the brewer, the beverage machine will pierce the beverage pod with one or more needles and hot water will be introduced into the pod under pressure to contact the beverage material. For a pod having a filter exposed, such as the Rogers OneCup™ pod, the pod will be short enough to avoid piercing by the lower needle. Once secured in the beverage pod cavity, pressurized hot water will permeate the beverage material in the beverage pod to fluidize some or all of the beverage material so as to generate the desired hot beverage for dispensing to the user. The used beverage pod will then be discarded, and the machine will be ready for further use with the same or a different type of beverage material. With such devices, users can customize their beverages and also enjoy a freshly brewed beverage quickly and easily.

Multi chamber beverage pods, and analogs thereto, such as drip coffee pods, can have a first chamber defined by a filter (typically a paper filter) that is loosely packed with ingredients (such as ground coffee) and a second chamber downstream of the first chamber that defines an empty space for receiving a prepared beverage that flows through the filter prior to dispensing into a cup or other beverage receptacle. One example of a multi chamber beverage pod is the Keurig K-Cup® pod. This pod includes a paper filter having a side wall that is sealed to an inside peripheral edge of the pod. The side wall of the filter is pleated or fluted to define channels extending between the top and bottom of the filter. Multi-chamber beverage pods are generally configured to provide for long-term freshness of the ingredients contained therein. To facilitate this, such pods can be treated to remove air therefrom, such as by application of a vacuum or by nitrogen purging. In recent years, alternatives to the multi-chamber pods have also been introduced. Such "generic" K-beverage pods can comprise pods that have a filter as part or all of the beverage pod or portion, along with a polymeric or foil lid adhered thereto. These non-airtight pods will not maintain the freshness of the contents therein.

As such, these pods will be supplied in airtight packaging or will bear shorter "use by" date.

Some beverage pods, such as espresso pods, have a single chamber defined by a plastic or aluminum body having a foil cover at one end. The chamber is densely packed with ingredients, such as finely ground coffee for producing beverages in a high pressure beverage preparing machine. One example of this configuration is the beverage pods that are sold under the Nespresso® brand name. For this type of device, the granular, or powdered, beverage material in the pod is generally partially soluble upon contact with hot water to generate the desired hot beverage. Upon insertion of the pod into the brewing machine pod cavity, which is in contact with the outer surface of the beverage pod, and application of hot water thereto, the pressure will increase in the chamber. As the pressure within the chamber increases, the foil cover is forced against raised projections in the machine's pod cavity to the point that the projections penetrate the cover to allow water to flow through the cover into the chamber and exit in the form of liquefied beverage material for use. Very small holes are generated in the bottom of the pod by the brewing machine. When wetted, the beverage material becomes tightly packed, thus substantially prevents the beverage material from exiting the chamber along with the liquid beverage. Thus, no filter is generally included in such pods. One example of a single chamber beverage pod is the Nespresso® Grands Crus pod. This pod has an aluminum body with a foil cover. The foil cover is pierced by square protrusions in the beverage pod cavity when hot water is injected under pressure by the beverage preparing machine into the chamber. Recently, "generic" espresso pods have become available. Such newer pods can be comprised of a polymeric beverage pod or container portion with a foil containing lid portion.

While the proliferation of generic beverage pods has increased the variety of beverage materials available, many consumers have special preferences in their hot beverage selections. Moreover, some consumers find the cost of retail beverage pods prohibitive, even though generic pods are generally at least 25% less expensive. While reusable products in which where the consumer fills the pod with her beverage material are available, such as the My K-Cup® pod product, these products are time consuming to prepare for use and can be messy. Moreover, the quality of the beverages prepared in these reusable products can be inconsistent.

There remains a need for systems and methods to allow a consumer to generate beverage pods for use in single serve beverage makers, where such pods can be customized with a desired type and amount of beverage material. The present disclosure provides this and other benefits.

SUMMARY

Aspects of the present disclosure are related to beverage pods, and their generation, for use in single serve beverage brewing machines. In one aspect, among others, a beverage material filling device comprises a belt system having a first end and a second end, and being engaged with a belt activator, thereby configuring the belt system to index along a beverage material filling device path; a beverage pod container delivery station configured to hold a plurality of beverage pod containers in a nested configuration, wherein the beverage pod container delivery station is configured to deliver one beverage pod container at a time to the belt system in a delivery operation proximate to the first end of the belt system; a beverage material delivery station configured to deliver beverage material to the beverage pod container when aligned with a beverage material exit at a bottom side of the beverage material delivery station, wherein the beverage pod container becomes aligned with the beverage material exit when the beverage pod container is indexed from the beverage pod container delivery station to the beverage material delivery station by the belt system; and a beverage pod lid delivery station configured to hold a plurality of beverage pod lids in a nested configuration, wherein the beverage pod lid delivery station is configured to deliver one beverage pod lid at a time to an interior opening of the beverage pod container when aligned with a lid discharge chute, wherein the beverage pod container becomes aligned with the lid discharge chute when the beverage pod container is indexed from the beverage material delivery station to the beverage pod lid delivery station by the belt system. In various aspects, the beverage pod container delivery station can comprise a container delivery chute in operational engagement with a container separator, the container delivery chute configured to accept a nested stack of beverage pod containers.

In one or more aspects, the container separator can comprise a plurality of cams rotationally engagable with a rim of a lowest beverage pod container in the nested stack of beverage pod containers in the delivery chute. Some or each of the plurality of cams can comprise a lower support finger configured to support the nested stack of beverage pod containers when that cam is in a first position and a tapered portion opposite the lower support finger, where the tapered portion is configured to separate the one beverage pod container from the nested stack of beverage pod containers as that cam rotates to a second position. The lower support fingers of the plurality of cams can be engaged with a lower surface of the rim of the lowest beverage pod container when in the first position. The tapered portions of the plurality of cams can apply a downward force to an upper surface of the rim of the lowest beverage pod container, or can apply an upward force to a lower surface of a rim of a next beverage pod container that is nested in the lowest beverage pod container, when rotating to the second position. In some aspects, a next beverage pod container can be nested in the lowest beverage pod container, and each of the plurality of cams comprise a top surface that engages with a rim of the next beverage pod container when that cam is rotating to the second position. The lower support fingers of the plurality of cams can be positioned under the rim of the next beverage pod container when the plurality of cams are rotated back to the first position.

In one or more aspects, the beverage material delivery station can comprise a containment hopper having a bottom opening, wherein the bottom opening is in operational engagement with at least one opening in a dosing plate. A dosing block can be rotationally engaged with the containment hopper and the dosing plate. The dosing block can comprise at least one volumetric beverage material loading chamber. The dosing block can comprise two or more volumetric loading chambers. A bottom of the dosing plate can comprise a plurality of grooves configured to substantially prevent accumulation of beverage material between the dosing plate and a dosing plate contacting side of the dosing block and a discharge port. The dosing block can be configured to deliver from about 2 grams to about 15 grams of beverage material to the beverage pod container when aligned with the beverage material exit of the beverage material delivery station.

In one or more aspects, the beverage pod lid delivery station can comprise a lid delivery chute in operational engagement with a lid separator. A lid fixing area can be configured to sealably fix the beverage pod lid in the interior opening of the beverage container as the beverage pod lid and beverage pod container are indexed to an exit location proximate to the second end of the belt. The lid fixing area can comprise a belt travel distance positioned between the beverage pod lid delivery station and the exit location. The belt travel distance can comprise a top interior side of the beverage material filling device and a top side of the belt system, wherein a clearance between the top interior side and the top side of the belt system decreases from a location after the beverage pod lid delivery station to a location before the exit location. The lid fixing area can comprise a lid fixing component configured to apply a sealing force to the beverage pod lid in the interior opening of the beverage container as the beverage pod lid and beverage pod container are advanced from the beverage pod lid delivery station to the exit location. In various aspects, the belt system can comprise two belts extending substantially in parallel from the first end to the second end, the two belts coupled at the first end to a common shaft driven by the belt activator. The belt activator can comprise a motor, and rotation of the motor by a fixed number of turns advances the beverage pod container from the beverage pod container delivery station to alignment with the beverage material exit of the beverage material delivery station. Further rotation of the motor by the fixed number of turns can advance the beverage pod container from the beverage material delivery station to alignment with the lid discharge chute of the beverage pod lid delivery station.

Still further, the present disclosure provides a pod (or container) for beverage material delivery from a single serving brewer device comprising a container lid and a bottom portion (or pod container). The bottom portion of the beverage pod container is configurable in a nested stack that is suitable for use in the beverage pod filling device of the present disclosure. The top portion of the pod container has a rim having an outer circumference and an inner circumference. The bottom portion has a sidewall length (or height) configured to fit within a chamber of a single serve brewing device, for example, about 2 to about 4 inches and to provide a hot beverage material therefrom. A plurality of stacked or nested beverage pods is also an aspect of the present disclosure.

Yet further, the present disclosure provides a beverage material container lid comprising an outer sidewall having a circumference, a sidewall, and a covering portion. A plurality of the container lids are stackable, where such configuration is suitable for delivery in the lid delivery station. The covering portion can be a separately applied film or foil material, or the covering material can comprise the same material as the rest of the container lid.

In a further aspect, the pods and lids are configured to have a complementary fit that is sealably engagable to generate a filled beverage pod for use. In some aspects, each of an upper portion of an interior sidewall of the pod container and an outer sidewall portion of the lid are tapered for engagement of the lid within the upper portion of the pod container when the lid is delivered from a pod lid delivery station of the beverage material filling device. Grooves, indentations, or protrusions can be incorporated on the pod container and/or the lids to improve the seal. An adhesive can be applied to the bottom side of the lid rim, or to the top rim of the pod container to ensure a secure fit.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 11A-11H illustrate a beverage pod bottom separator having ramped cams.

DETAILED DESCRIPTION

Figure 1A:
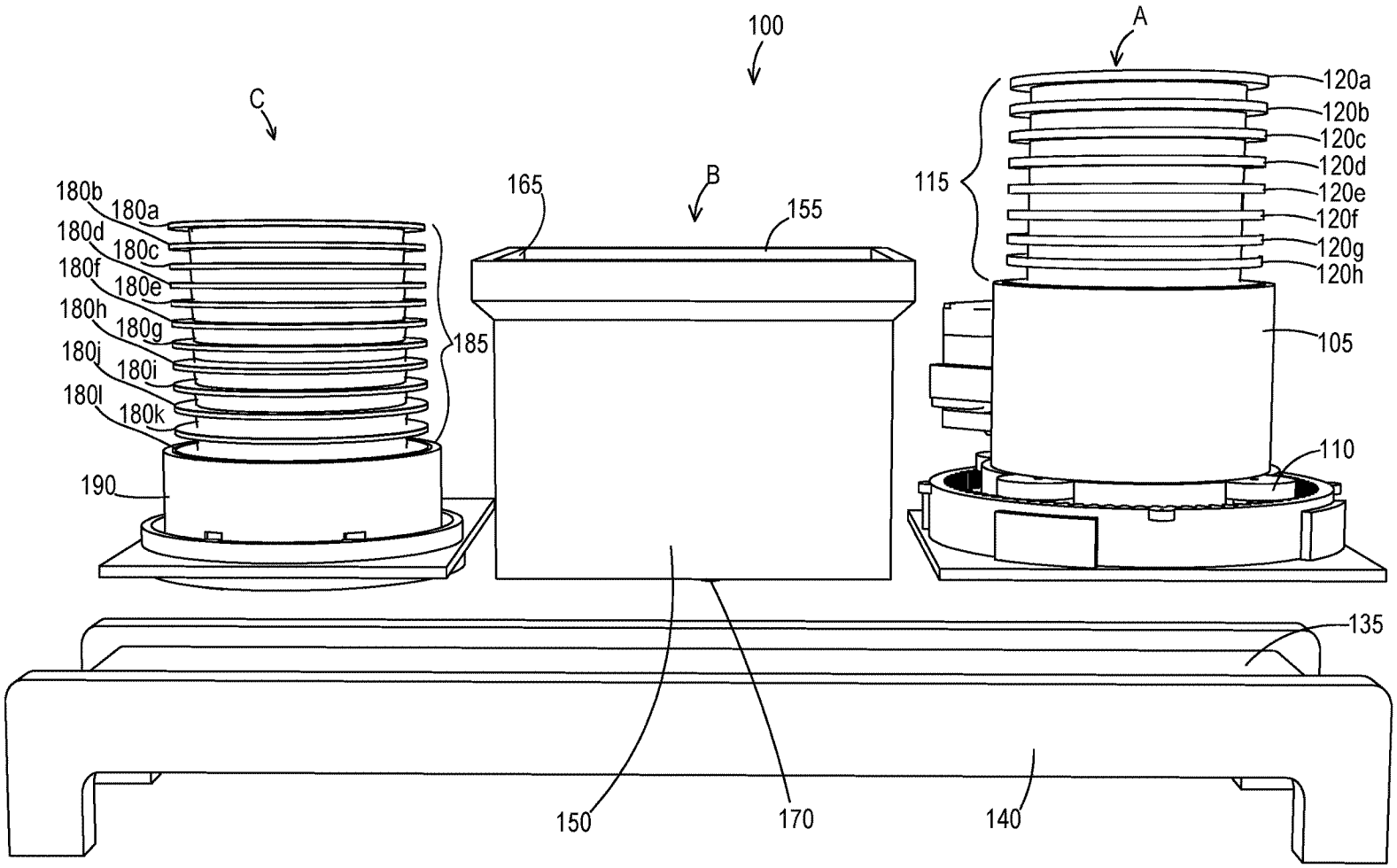
FIGS. 1A-1H illustrate various aspects of the operation of the beverage pod filling device and its componentry, in accordance with various aspect of the present disclosure.

In the following detailed description, reference is made to the accompanying drawings, which form a part hereof, and within which are shown by way of illustration certain embodiments by which the subject matter of this disclosure may be practiced. It is to be understood that other embodiments may be utilized and structural changes may be made without departing from the scope of the disclosure. In other words, illustrative embodiments and aspects are described below. But it will of course be appreciated that in the development of any such actual embodiment, numerous implementation-specific decisions must be made to achieve the developers' specific goals, such as compliance with system-related and business-related constraints, which may vary from one implementation to another. Moreover, it will be appreciated that such development effort might be complex and time-consuming, but would nevertheless be a routine undertaking for those of ordinary skill in the art having the benefit of this disclosure.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

When the phrases "for example," "such as," "including" and the like are used herein, the phrase "and without limitation" is understood to follow unless explicitly stated otherwise.

The terms "comprising" and "including" and "involving" (and similarly "comprises" and "includes" and "involves") are used interchangeably and mean the same thing. Specifically, each of the terms is defined consistent with the common United States patent law definition of "comprising" and is therefore interpreted to be an open term meaning "at least the following" and is also interpreted not to exclude additional features, limitations, aspects, etc.

The term "about" is meant to account for variations due to experimental error. All measurements or numbers are implicitly understood to be modified by the word about, even if the measurement or number is not explicitly modified by the word about.

The term "substantially" (or alternatively "effectively") is meant to permit deviations from the descriptive term that do not negatively impact the intended purpose. Descriptive terms are implicitly understood to be modified by the word "substantially," even if the term is not explicitly modified by the word substantially.

In broad constructs, the present disclosure provides systems, devices and methods for generating single use beverage pods having beverage material incorporated therein for use in single serve hot beverage brewing machines. Innovative beverage pod container bottom and lid components, as well as assemblies thereof are also disclosed, where such assemblies are configured for use in the beverage pod filling devices of the present disclosure. The beverage pod filling device, as well as the associated systems and methods, are configured to have a small footprint relative to prior art pod filling machines, which generally require substantial floor space and, thus, are not suitable for use in a home or office environment. In some implementations, the device is less than about 24 or 18 or 12 inches (or less than about 61 or 45.8 or 30.5 cm) in length and less than about 16 or 12 or 8 inches (or less than about 40.7 or 30.5 or 20.3 cm) in width and less than about 24 or 18 or 12 inches (or less than about 61 or 46 or 30.5 cm) in height. The inventive beverage pod filling device is configurable to generate a plurality of beverage pods having a selected beverage material enclosed. Such beverage pods can be customized with a desired type of beverage material as selected by a user.

The beverage pod filling device of the present disclosure can incorporate functionality to allow a plurality of filled beverage pods to be generated substantially without operator intervention during the beverage pod generation steps. Instructions can be provided to the filling device via communications capability incorporated therein as discussed hereinafter. In some implementations, the beverage pod filling device can comprise a plurality of stations that each, independently, comprise a step in the beverage pod filling operation. In some aspects, the plurality of stations comprises a beverage pod container delivery station, a beverage material delivery (or dosing) station, and a beverage pod (or container) lid delivery station.

Once an unfilled beverage pod container is delivered from a nested container assembly of the beverage pod container delivery station to a belt (or belts) via a container delivery chute and transported to the beverage material delivery station, a portion of the beverage material can be dosed into the beverage pod container. Once filled, the filled but not-yet-lidded beverage pod container can be indexed by the belt(s) to the beverage pod lid delivery station, whereby a lid can be delivered from a stacked assembly of lids via a lid delivery chute. Once the lid is in position on the container, the lid can be sealably fixed on or engaged with the filled beverage pod container, making it ready for use, and then delivered from the filling device by discharging the filled beverage pod down a chute, belt(s), or the like for collection by the user.

As illustrated in FIG. 1A, in some aspects, the inventive beverage pod filling device 100 can comprise a plurality of stations, each of which perform different functions in the beverage pod filling operation. FIG. 1A, and accompanying FIGS. 1B-1G illustrate an aspect the operation of the beverage pod filling device 100 including three stations, A, B and C. In use, such componentry can be incorporated within a cover, casing, housing or the like to shield some or all moving parts from contact with a user's hands and to keep the inner components free of dust, dirt or other possible contaminants, for example. However, for the purpose of explanation herein, a cover is not illustrated.

As shown in FIG. 1A, Station A (e.g., a beverage pod container delivery station) comprises a beverage pod container delivery chute 105, wherein the delivery chute 105 is in proximal and operational configuration with a beverage pod container separator 110. The container delivery chute 105 is configured to store and align a plurality of beverage pod containers 120*a-h* in a stacked configuration 115 for dispensing by station A. In the example of FIG. 1A, the container delivery chute 105 is cylindrical with a circular cross-section that encircles at least a portion of a stack of beverage pod containers 120, however the height of the chute 105 can be shorter or taller than depicted in FIG. 1A. In one configuration, the beverage pod container delivery chute 105 can be integrated with a housing (not shown) such that an opening (not shown) in the housing provides access to the container delivery chute 105 for loading the beverage containers 120*a-h* therein. Container delivery chute 105 can also be removable from the beverage pod filling device 100 to facilitate loading of the beverage pod containers 120 in the stacked configuration 115.

The beverage pod container stacked configuration 115 comprises a plurality of unfilled beverage pod containers 120*a*, 120*b*, 120*c*, 120*d*, 120*e*, 120*f*, 120*g*, and 120*h*, which can comprise more or fewer stacked unfilled containers as discussed further herein. The pod containers 120 in this configuration 115 are stackable in the container delivery chute 105, with the lowest (or first) beverage container (See, e.g., 125 of FIG. 1B) of stacked beverage pod container configuration 115 being inside the delivery chute 105 and in operational communication with the beverage pod container separator 110. The exemplary beverage pod container separator 110 is configured to separate the lowest container from the stacked container configuration 115 as discussed in more detail hereinafter.

Figure 1B:
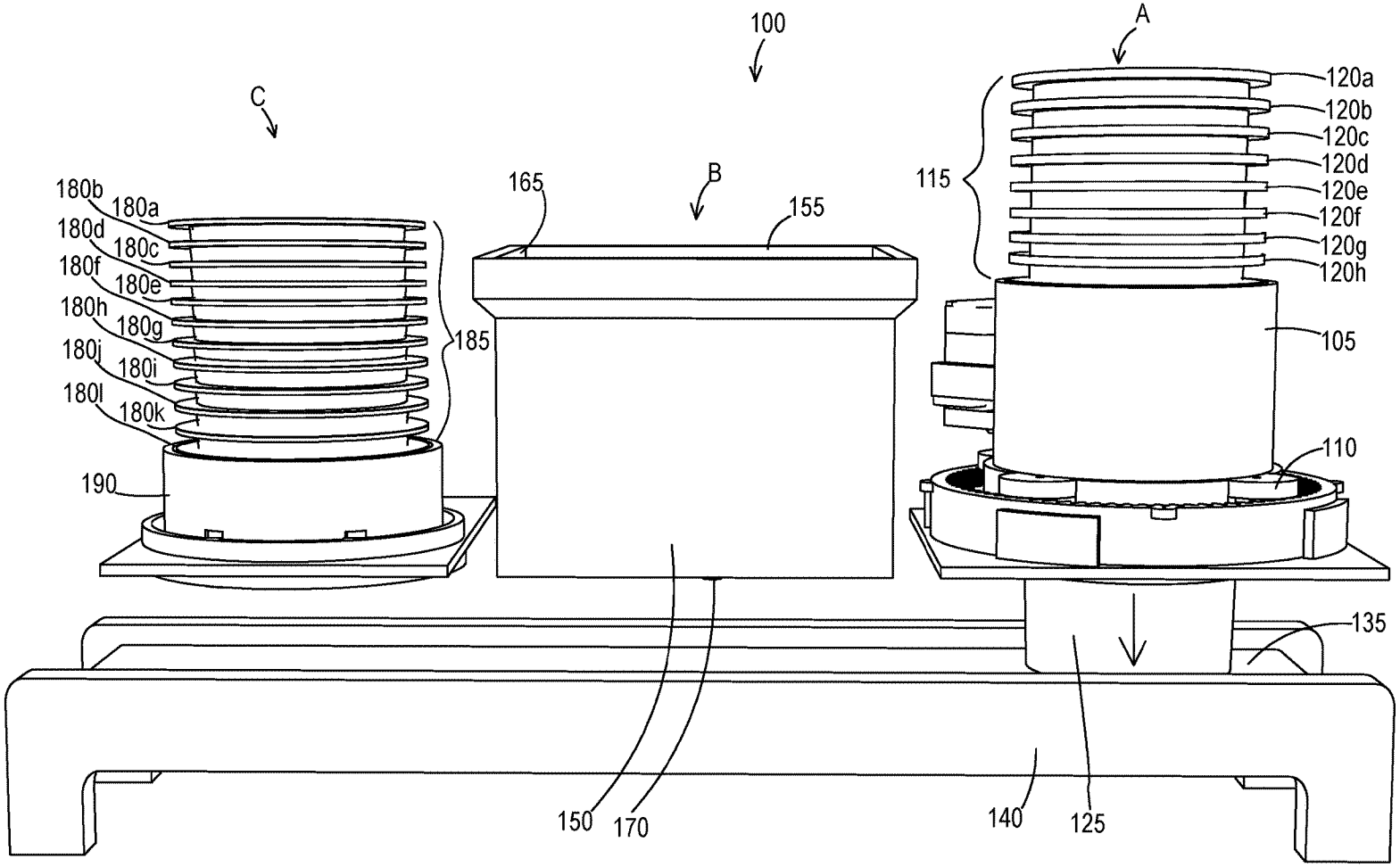
Figure 1C:
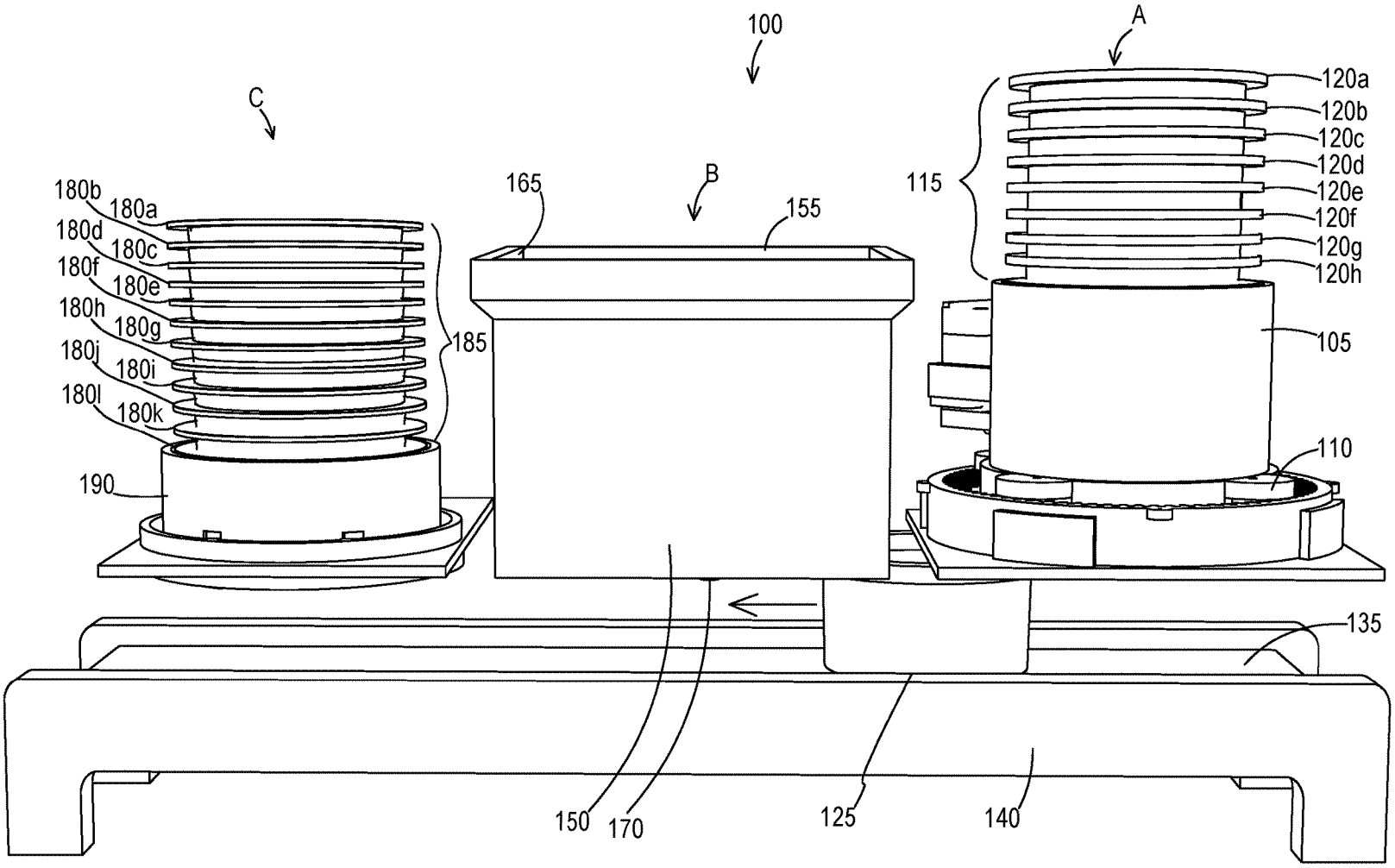

Referring to FIG. 1B, in use, the lowest beverage pod container 125 is delivered from the container delivery chute 105 by the container separator 110 onto belt(s) 135. For example, the bottom of the discharged container 125 can rest on a belt 135 as illustrated in FIG. 1B. Rails, guides or other support mechanisms can be located on the sides of the belt 135 to maintain the container 125 upright as it is transported by the belt 135. In some embodiments, fingers or tabs can extend from the outer surface of the belt 135 that align the bottom of the discharged container 125 on the belt 135 for indexing during movement of the container 125 between the stations. In other implementations, the container 125 can be supported by a pair of belts located on opposite sides of the discharged container 125. A rim of the beverage pod container can rest on the belts while the sidewalls extend downward between the belts. The belt(s) 135 can be in operational communication with a filling device bottom portion 140 via a belt activator (not shown) such as, e.g., a stepper motor or other appropriate drive mechanism. The belt activator can operate according to a timed sequence to allow the dispensed beverage pod container 125 to move between stations A, B and C in use, as discussed further hereinafter. In another implementation, movement of the pod container can be facilitated by a pair of rails located on opposite sides of the pod container, which support the container by the underside of the rim. Movement of the pod container can be actuated via a push rod or other type of device acting upon the pod container, thereby providing movement of the pod container along the support rails for appropriate alignment with various stations such as, but not limited to, material delivery (filling) and lid delivery (lidding).

Station B (e.g., a beverage material delivery station) comprises a beverage material containment hopper 150 having a top opening 155 for loading of the beverage material (not shown). The hopper 150 is in operational communication with beverage material doser componentry (not shown). Operation of the beverage material doser componentry is illustrated hereinafter with respect to FIGS. 12-16. The beverage material containment hopper 150, in some implementations, can incorporate a cover (not shown) that can be engageable with an inner sidewall 165, to, for example, maintain the cleanliness of any beverage material stored therein. When present, the cover (not shown) can be attached via a hinge (not shown) or other appropriate fastener assembly, or can be fully separable from the hopper 155, as non-limiting implementations. Yet further, the beverage material containment hopper 150 can be removably engageable with the beverage pod filling device 100, for example, to allow cleaning and filling of the hopper 150. When removably engageable with the filling device 100, multiple containment hoppers 150 can also be used to store different flavors/types of beverage materials so as to allow a user to select different types of beverage material as desirable.

Figure 1D:
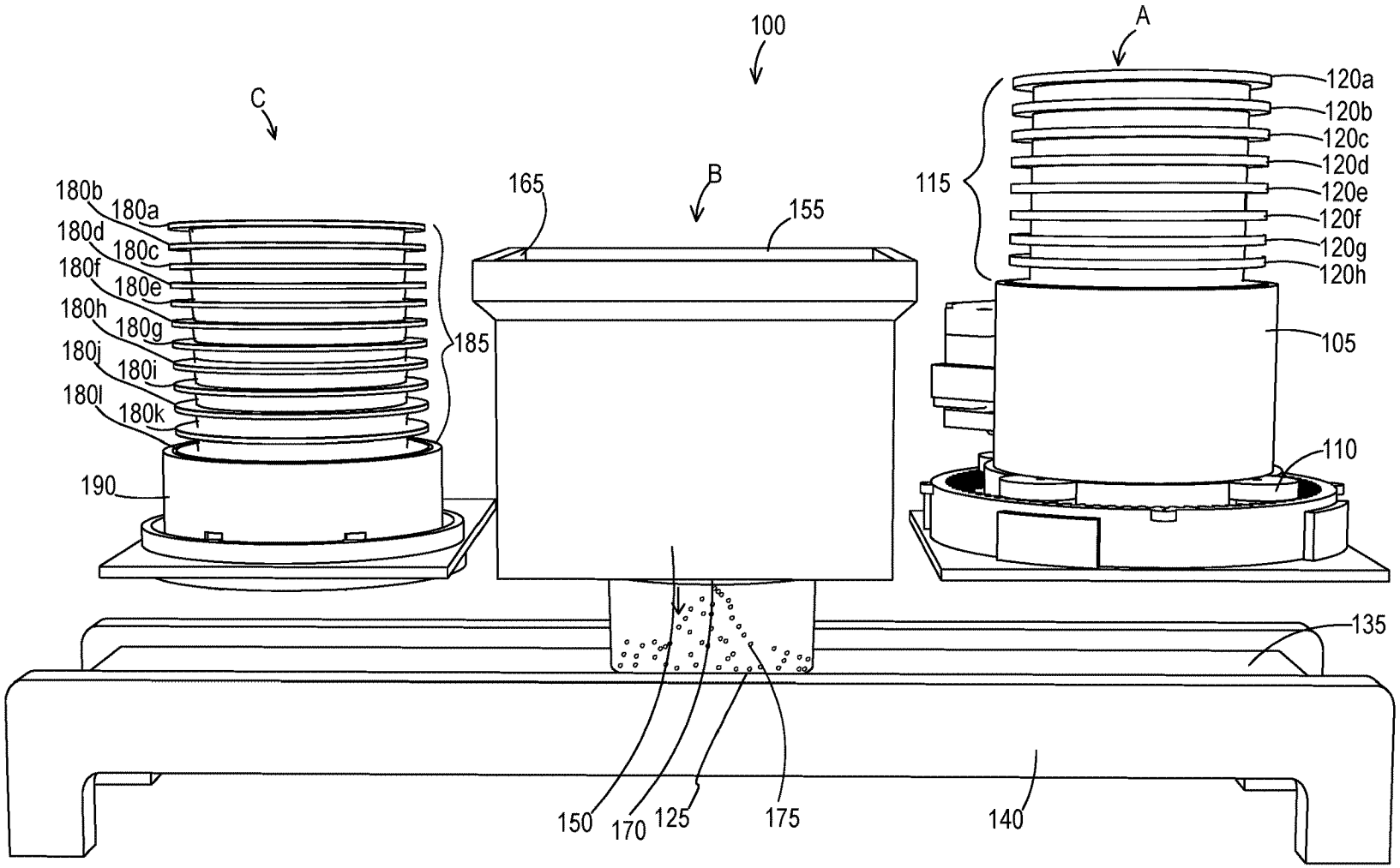
Figure 10B:
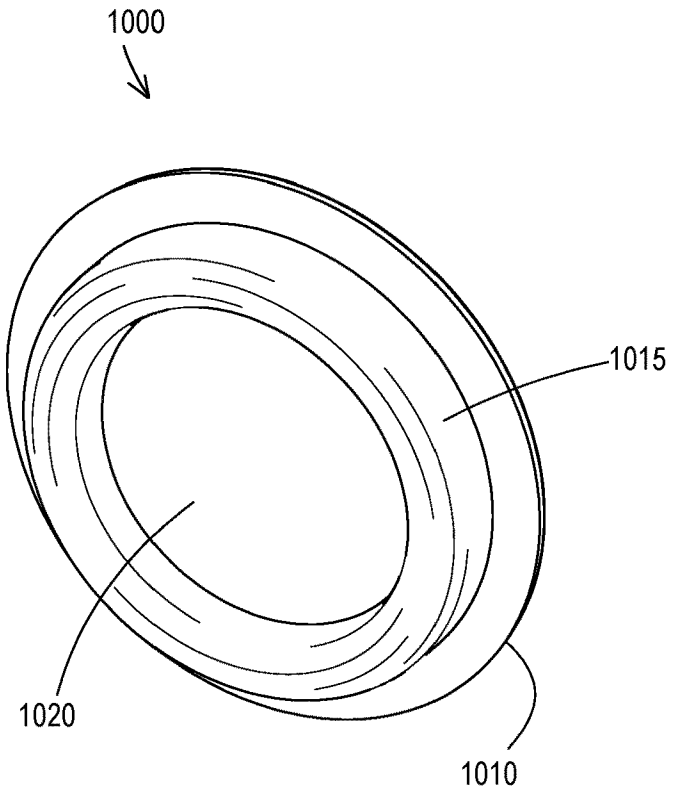
FIGS. 10A and 10B illustrate an exemplary beverage pod lid configuration.

In use, and as shown in FIGS. 10 and 1D, the beverage pod container 125 dispensed from the container delivery chute 105 is indexed along belt(s) 135 according to a timed sequence operation with the belt activator (not shown) to be delivered in alignment with a beverage material delivery opening 170 positioned at the bottom end of the beverage material containment hopper 150. Such timed sequence can be operational with one or more microprocessor controlled features. For instance, the belt(s) 135 can include one or more toothed belt (e.g., cogged or timing belts) supported by gear belt pulleys or sprockets. The positioning of the belt(s) 135, and thus the beverage pod container 125 below stations A, B and/or C, can be controlled by controlling the rotations of the gear belt pulleys or sprockets using a stepper motor or other appropriate drive mechanism. By controlling the amount of rotation or the number of rotations of the gear belt pulley, the distance transitioned by the belt(s) can be controlled for proper positioning of the container 125 supported by the belt(s) under the stations A, B and/or C. In some embodiments, sensors such as, e.g., a positional (or proximity) sensor (not shown) can be included to ensure alignment of the beverage pod container 125, e.g., with the delivery opening 170 prior to beverage material delivery therein. As shown in FIG. 1D, when the beverage pod container 125 is suitably aligned with the delivery opening 170, beverage material 175 can be delivered into the beverage pod container 125 via the doser delivery componentry of station B, as discussed in more detail hereinafter.

Station C (e.g., a beverage pod lid delivery station) comprises a beverage pod lid delivery chute 190 configured to deliver a lid on the filled container 125. Beverage pod container lids 180*a*, 180*b*, 180*c*, 180*d*, 180*e*, 180*f*, 180*g*, 180*h*, 180*i*, 180*j*, 180*k*, and 1801, as an exemplary configuration of stacked lid configuration 185, are arranged for delivery in Station C. More or fewer lids 180 can be incorporated in the stacked lid configuration 185, as can be appreciated. The lowest (or first) lid 195 (not shown) is arranged in the lid delivery chute 190 which is in proximal and operational communication with a lid separator (not shown).

Figure 1E:
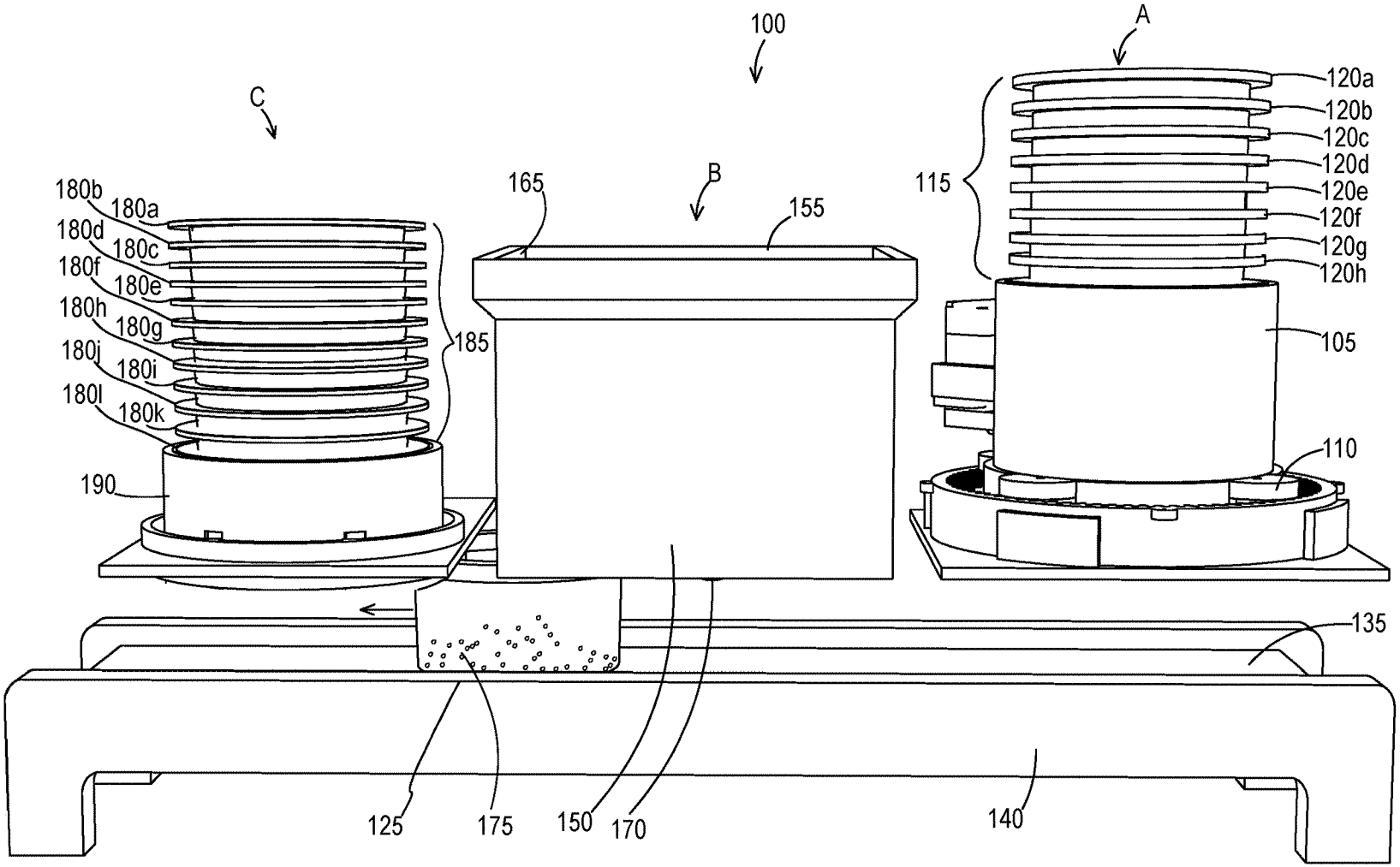
Figure 1F:
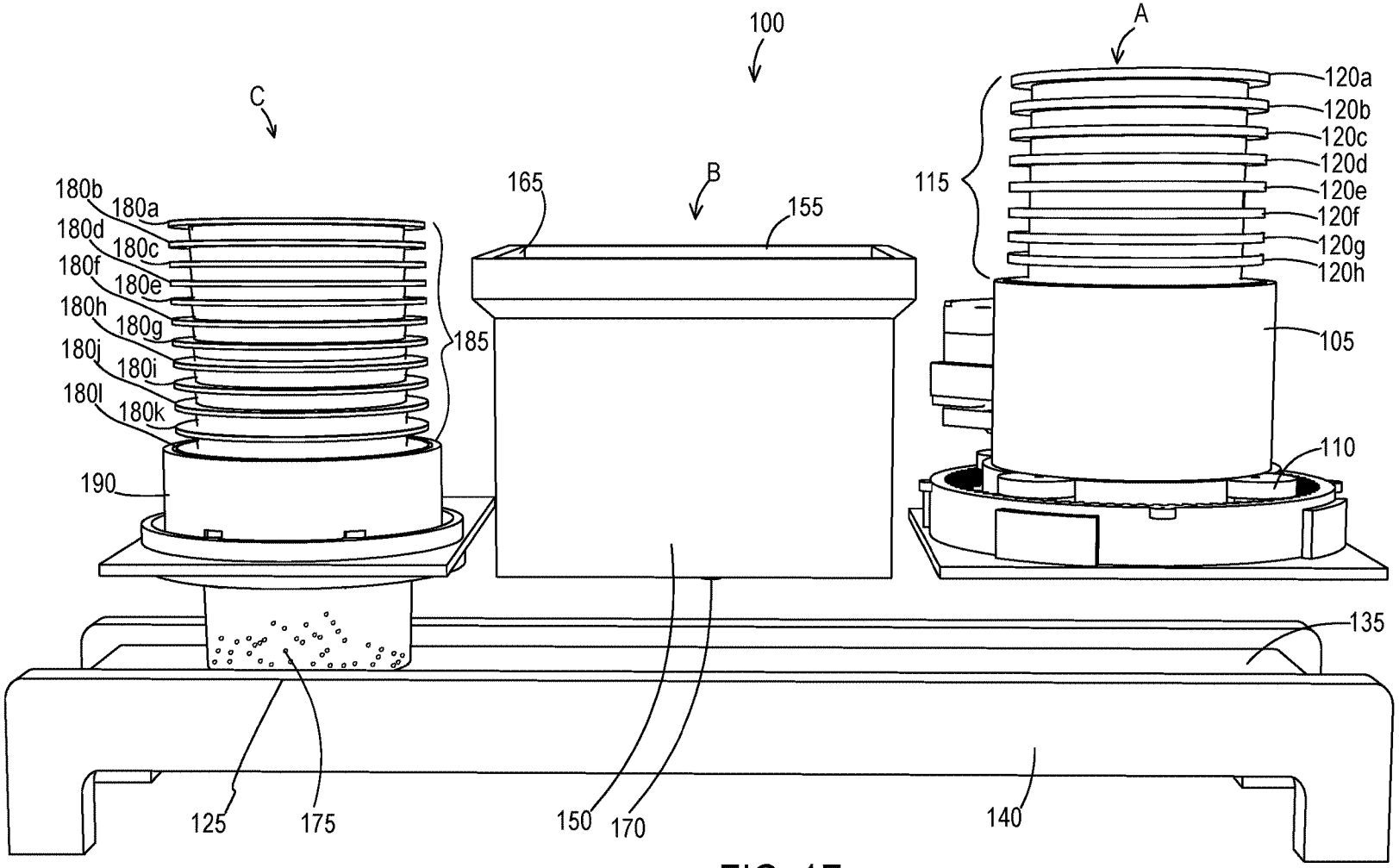
Figures 1, 1F:
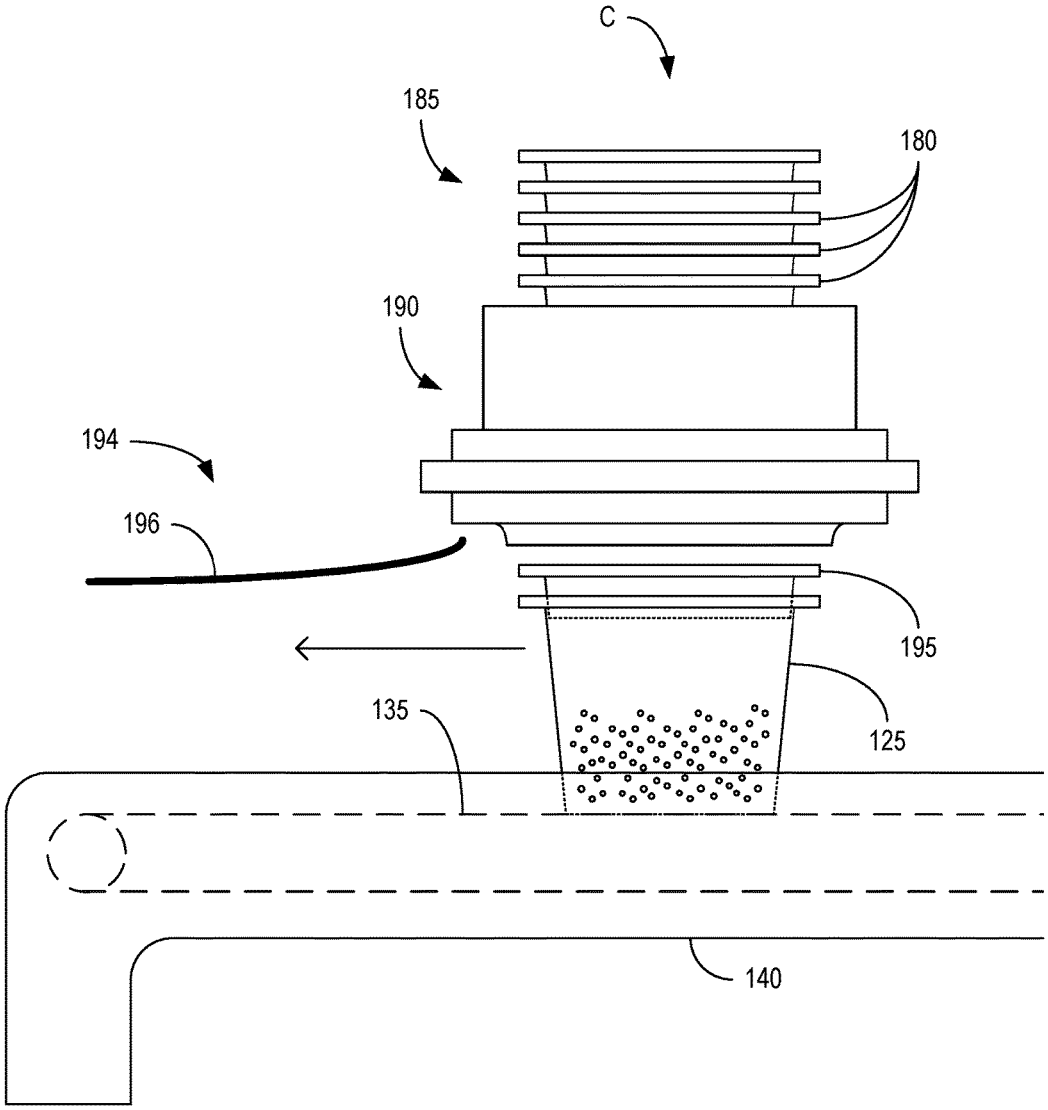
Figure 1G:
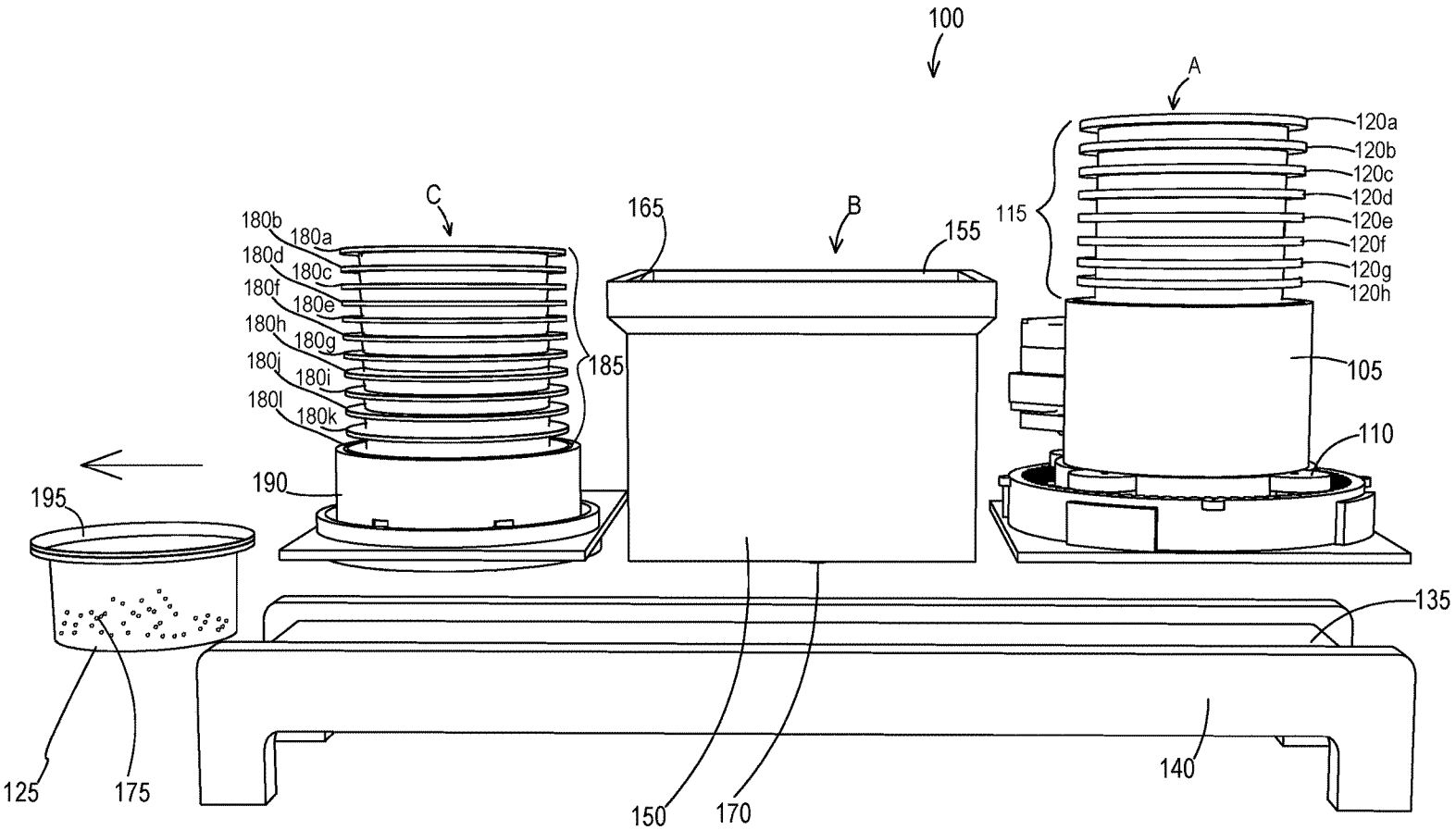
Figures 1, 1G:
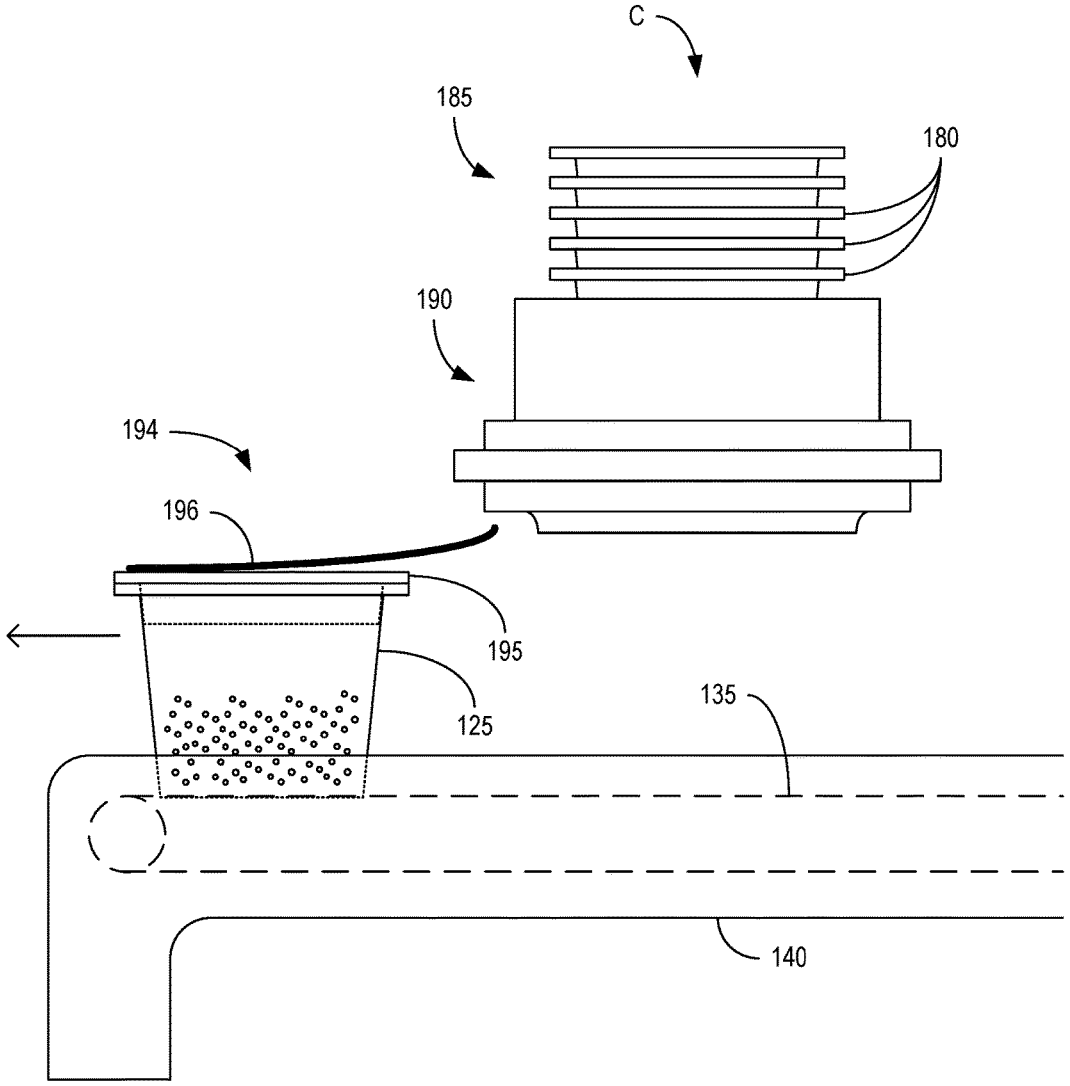

Referring to FIGS. 1E, 1F and 1F-1, the beverage pod 125 (now filled with the beverage material 175), is advanced to Station C, wherein the lowest lid 195 (shown in side view of FIG. 1F-1) is delivered from the lid delivery chute 190 onto beverage pod 125 according to a timed sequence via the lid separator (not shown). As discussed further hereinafter, the inventive lids 180 are configured to have an engageable fit with inventive beverage pods 120 such as by a complementary tapered fit between the upper portion of the beverage pod container 120 and the lid 180. Upon delivery of lowest lid 195 to the top of the filled beverage pod container 125 aligned with the lid delivery chute 190, belt(s) 135 will move the beverage pod container 125/lid 195 combination a lid fixing area 194 to the exit device 100 as shown in FIGS. 1G and 1G-1. When traveling along the belt(s) 135, pressure can be applied to the lid 195, so as to ensure that lid 195 is fully engaged with beverage pod 125. As discussed hereinafter, full engagement of the lid 195 can be facilitated by reducing the clearance between the top of the belt(s) 135 and a lid fixing component 196 (shown in side view of FIG. 1G-1) of the beverage pod filling device 100.

Beverage pod filling device 100 can be configured to generate at least one or about two, or about four, or about six, or about sixteen, filled and lidded beverage pods per each minute. As would be appreciated, the number of filled and lidded beverage pods that can be generated in a single filling operation will be, at an upper amount, largely dependent on the supply configuration (i.e., beverage pod containers, beverage material, and/or lids) that can be operationally provided to the filling device 100 in a single operation. From time to time, the supplies (i.e., beverage pod containers, beverage material, and lids) may become depleted, and the user can replenish one or more as appropriate.

Figure 1H:
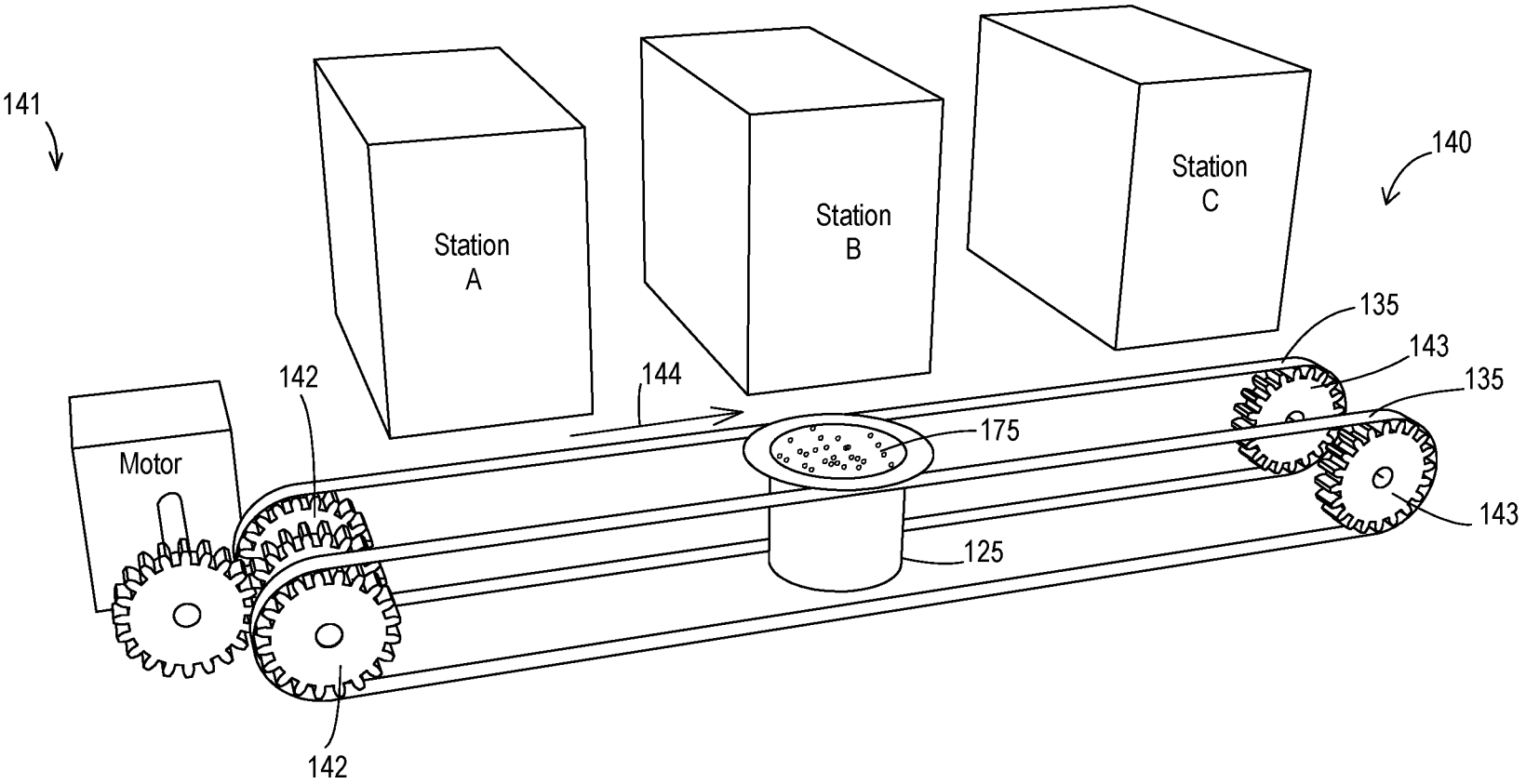

Referring now to FIG. 1H, shown is an example of a filling device bottom portion 140 including two belts 135 controlled via a belt activator 141. The belts 135 extend from a proximal end adjacent to station A to a distal end extending beyond station C. At the proximal end, the belts 135 can be coupled to gear belt pulleys or sprockets 142 that engage with teeth along an inner surface of the belts 135. Pulleys or sprockets 143 can be coupled to the distal end of the belts 135, and can be connected to a tensioning device (not shown) to maintain the appropriate tension on the belts 135. The filling device bottom portion (not shown) can provide support for the belt activator 141, the gear belt pulleys or sprockets 142 and 143, and/or the tensioning device. As illustrated in FIG. 1H, the rim of the beverage pod container 125 is supported between the belts 135. Indexing the movement of the container 125 between the stations A, B and C can be provided by the combination of teeth on the inner surface of the belts 135 and the gear belt pulleys or sprockets 142. After the beverage pod container 125 is discharged onto the belts 135 at station A, the position of the container 125 can be controlled based upon the rotation of the gear belt pulleys or sprockets 142, which is converted to a linear motion 144 by the belts 135. Coupling the gear belt pulleys or sprockets 142 to a common shaft allows both belts 135 to rotate equally, thereby avoiding rotation of the container 125 which could result in misalignment with the stations B or C. In some embodiments, fingers or tabs can extend from the outer surface of the belts 135 that align the rim of the discharged container 125 on the belts 135 for indexing during movement of the container 125 between the stations. The belt activator 141 can include gearing coupled to the common shaft. The gearing ratio can define the relationship between shaft rotation of the belt activator 141 and the amount of linear movement provided by the belts 135. For example, the belt activator 141 can be controlled to rotate a fixed number of turns (e.g., integer or fractional turns), which will be translated into a fixed linear movement of the container 125.

In various embodiments, the separation between stations A, B and C can be equal so that an integer number of turns of the belt activator 141 moves the beverage pod container 125 between each pair of stations. For instance, after the beverage pod container delivery station A discharges a first container 125 onto the belts 135, the belt activator 141 can be rotated the defined number of turns (e.g., six), thereby moving the first container 125 into position under the beverage material delivery station B. While the first container 125 is being filled with the beverage material 175, a second container 125 can be discharged onto the belts 135. When the first container 125 is filled, the belt activator 141 can again be rotated by the defined number of turns (e.g., six), thereby moving the first container 125 into position under the beverage pod lid delivery station C and moving the second container 125 into position under the beverage material delivery station B. A lid 195 can then be positioned on the first container 125, while the second container is being filled with the beverage material 175, and a third container 125 is being discharged onto the belts 135. When the second container 125 is filled, the belt activator 141 can again be rotated by the defined number of turns (e.g., six), thereby moving the first container 125 under a lid fixing component 196 (FIGS. 1F-1 and 1G-1) configured to secure the lid 195 on the container 125 and discharging the completed beverage pod from the filling device 100. At the same time, the second container 125 is moved into position under the beverage pod lid delivery station C and the third container 125 is moved into position under the beverage material delivery station B. The cycle can be continued until the desired number of beverage pods are filled by the device 100.

A variety of unfilled beverage pods can be used with the beverage pod filling device 100, as long as a plurality of the beverage pods containers 120 can be configured in a stacked arrangement 115 where the distance between the rims of the different stacked containers is approximately equal. Such approximately equidistant rim configuration has been found to facilitate stackability and separation of the containers 120, as well as to allow the beverage pod container separator 110 to operate substantially without jamming or blocking the beverage pod container delivery chute 105. In this regard, it has been determined that a single beverage pod container 125 can be delivered from container delivery chute 105 onto the indexing belt(s) 135 without sticking or jamming when the beverage pod container separator 110 consistently disengages a lower unfilled beverage pod container 125 from the stacked arrangement 115 above.

The beverage pod filling device 100 and componentry of the present disclosure are compatible with a number of unfilled beverage pod configurations, that is, the container of the pod in which the beverage material is held. In one aspect, the unfilled beverage pod can be configured to have a continuous sidewall portion or can be configured without a continuous outer sidewall where the specific configurations of such exemplary beverage pods are discussed hereinafter.

In some implementations, the lower portion of the beverage pod container 120 and the associated lid 180 having the complementary engageable fit can each, independently, be constructed of a material that is capable of being pierced or perforated by first and second piercing members, that is, one or more needles—typically a first needle that pierces the lid 180 and a bottom needle that pierces the bottom of the container 120, of a single-serve beverage machine to allow the introduction of liquid (e.g., hot water) into the beverage pod in use. As noted, beverage pods that can be generated by the beverage pod filling device 100 can be used in either the Keurig® or Nespresso® type coffee makers or generic equivalents, with the former generally suitable to make coffee, tea, cocoa, and the latter generally used to make expresso-type drinks having various strengths. In some aspects, pods and lidding material will not require piercing by a needle, for example, those having a non-solid (e.g., mesh or other filter) bottom and/or sidewalls.

The unfilled beverage pod can be made of one or more materials, such as metal (e.g., aluminum), polymers (e.g., plastic, polyethylene, polyurethane, nylon), and/or biodegradable materials. In some aspects, all or part of the stackable beverage pod container 120 and the lid 180 can be constructed of a flexible material. In certain instances, the lid 180 of the unfilled beverage pod can be pierced or perforated by a piercing member associated with the beverage brewing machine in which the beverage pods are used. The lids 180 for the beverage pods can be configured as set out hereinafter. The beverage pod containers 120 and lids 180 can be thermoformed according to known methods.

To facilitate recyclability, the filter, container, and lid material can be comprised of the same material, such as polypropylene #5, so that it can be placed in a single stream. To this end, for K-Cup® type beverage pods, the lid covering material, which is attached prior to delivery of the pod to a user, can be comprised of polymeric material that is fusion bonded or otherwise adhered to a top or bottom surface of the lid as discussed further herein. Still further, for Nespresso® type beverage pods, the lid covering material can be made out of a metallic material, such as aluminum or thermofoil or other suitable material, and attached to an upper or lower surface of a lid via heat fusion or adhesive, for example. Metallic material can be especially useful when Nespresso® type pods are being generated according to the disclosure herein, as such machines generally call for a more resilient covering to comport with the functional requirements of the beverage machine. All or some part of the lids can be configured from biodegradable material. Material may be perforated to allow beverage flow.

Figure 2:
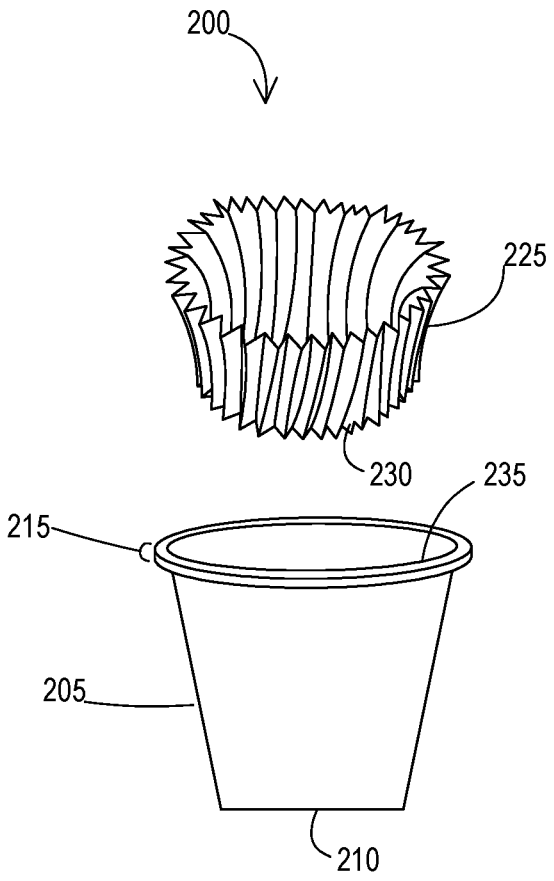
FIG. 2 illustrates an exemplary beverage pod container with a filter that can be used in, e.g., a Keurig® brewer or a generic equivalent thereof.

In a first configuration as shown in FIG. 2, a beverage pod 200 having a continuous sidewall 205 and solid bottom 210, which is pierceable by a needle configured in a single serving brewer device (not shown) is illustrated with a rim 215 having a configuration for engagement of a lid (not shown) having a complementary configuration as discussed further hereinafter. Filter 225 is configurable within the beverage pod 200 and is shown in a fluted paper configuration, but other filter configurations are suitable for use herein, as long as such filter configuration does not detract from the stackability of a plurality of beverage pods in the inventive beverage pod filling device 100 as discussed herein. In this regard, as shown in FIG. 2, filter 225 has flat bottom 230 that is configured to fit in the interior 235 of the pod 200. Beverage pod 200 can be suitable for use in Keurig® brewers, and/or other "generic" devices configured for use of such beverage pods.

Figure 3A:
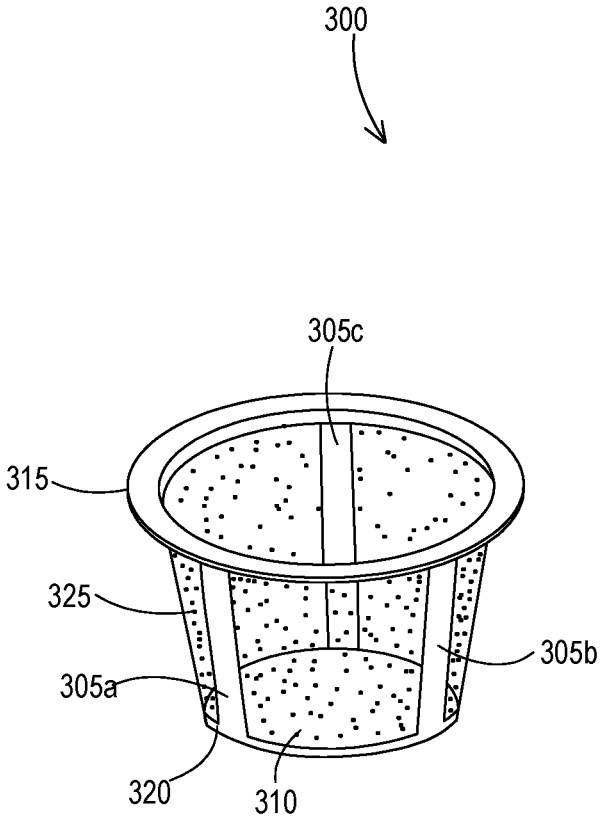
FIGS. 3A and 3B illustrate exemplary beverage pod containers that can be used in, e.g., a Keurig® brewer or a generic equivalent having an exposed filter.
Figure 3B:
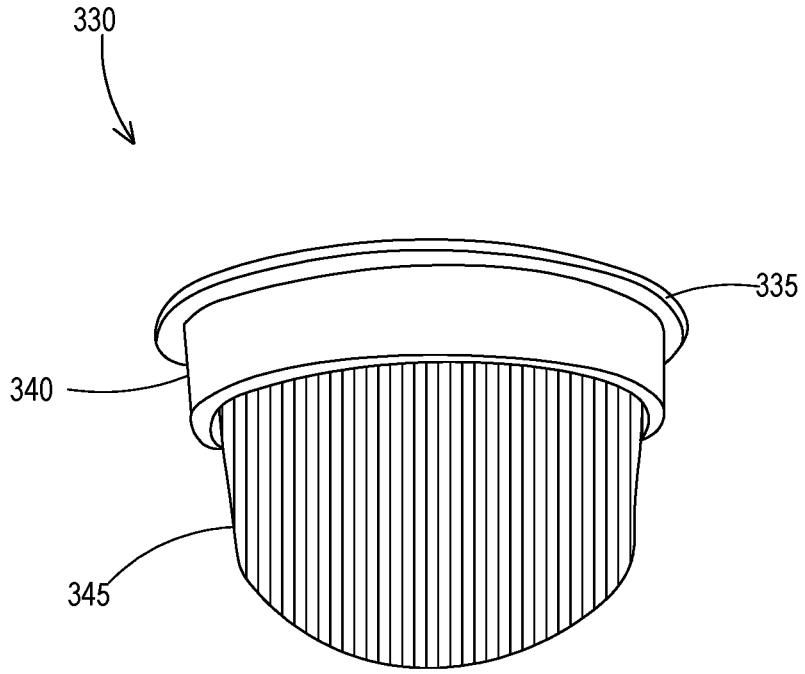

In further implementations, the filter 225 may not be enclosed in a continuous cup. In such configurations, the height of the beverage pod 200 can be such as to avoid the needle that is present in the bottom of a beverage pod cavity in a brewer. In one such implementation, as shown in FIG. 3A, the beverage pod 300 does not comprise a continuous sidewall and solid bottom, as is shown in FIG. 2. Rather, the beverage pod 300 comprises a plurality of ribs 305*a*, 305*b*, 305*c* extending between a lower rim 320 of a solid bottom portion 310 and an upper rim 315 of the pod 300. The beverage pod 300 is configured for use in a single serving brewer device. Non-woven filter material 325 is shown attached to ribs 305*a*, 305*b*, and 305*c*, as well as to bottom portion 310. In contrast to beverage pod 200, the filter material 325 is exposed in beverage pod 300. Attachment of filter material 325 to the ribs 305*a*-305*c* and the bottom portion 310, can be via fusion bonding and/or a food safe adhesive. Beverage pod 300 can be suitable for use in Kuerig® brewers, and/or other "generic" devices configured for use of such beverage pods. Yet further, as shown in FIG. 3*b*, beverage pod 330 has a rim 335, a sidewall 340 and a mesh filter 345 attached to an inner side of the sidewall 340, such as by thermofusion. The rim 335 and sidewall 340 can be of a biodegradable or compostable material.

Yet further, an unfilled beverage pod can be generated with reduced material usage by perforating the sides and/or bottom of the beverage pod outer material (not shown), where the bottom and sides are comprised of a polymeric material, such as the material from which the continuous sides and bottoms are configured. Such perforations can be configured to allow liquid passing through the beverage pod, when in use, to flow through such perforations with or without a filter material incorporated therewith. In some aspects, the beverage pod container can comprise a plurality of perforations, where such perforations are sized to allow the liquified beverage material to flow out of the beverage pod when the hot water infusion is provided. When a ground material having a size that is larger than the perforations in the container is used therein, the perforations will act to keep the ground material in the beverage pod and out of the brewed beverage. For powdered beverage material, the perforations will operate to allow the liquified beverage material to flow therethrough. A filter material, for example, paper or non-woven can optionally be incorporated into the perforated container.

As would be recognized, if the beverage pod container comprises openings that are larger than the beverage material incorporated therein, such as with a ribbed sidewall configuration, a non-woven filter material will be included. Such filter can comprise a liquid permeable non-woven material that is flexible for insertion into the container. As would be recognized, to allow the beverage pod to be suitably nested, as well as to be readily separable, the filter can be configured to substantially in the shape of the container, and not in a cone shape or the like, which could decrease the ease of stackability. Still further, the filter material can be integrally formed into the frame and cover a plurality of side openings generated by the ribs or perforations as discussed previously.

When a non-woven filter material is used, it can be fusion bondable to the structural aspects of the container, for example the ribs or base material upper rim. To facilitate recyclability, the filter material can be made from the same material as the container (for example, polypropylene or polyethylene), or it can be different if a user will separate the various container aspects for recycling.

In some aspects, a filter material may not be incorporated into the beverage pod, such as when a powdered beverage material is incorporated into the beverage pod for use. While a ground material, such as coffee or tea leaves, is commonly incorporated into such beverage pod for use with a filtered beverage pod, powdered material, such as cocoa mix, instant coffee, instant tea, soup, etc. can also be used as the beverage material. As such, in some implementations, the filter material is optional for use in the beverage pod herein, where such optionality is dependent, at least in part, to the type of beverage material dosed in the beverage pod.

Figure 4:
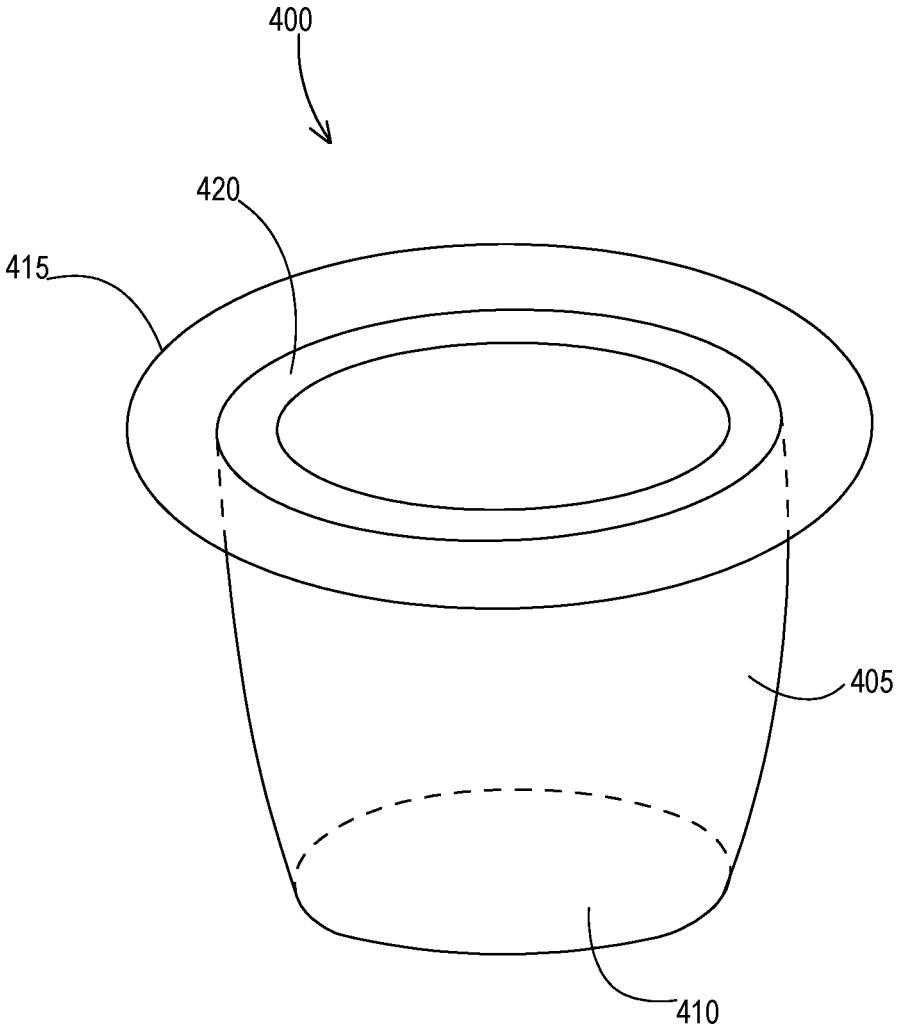
FIG. 4 illustrates an exemplary beverage pod container that can be used in, e.g., a Nespresso® brewer or a generic equivalent thereof.

Referring to FIG. 4, a beverage pod 400 having continuous sidewall 405, solid bottom 410, rim 415, and interior rim sidewall 420 is shown. Beverage pod 400 can be suitable for use in Nespresso® brand brewers, as well as other "generic" devices configured for use of such beverage pods. Further with regard to such "Nespresso-type" beverage pods, the lid material can be permeable and attached to a rim that is configured to be delivered from the lid delivery chute 190 (FIG. 1A).

In notable aspects, the beverage pod filling devices 100 of the present disclosure are indicated by the absence of functionality that would generally be present in commercial beverage pod filling machines. In short, the elimination of such functionality facilitates a small footprint for the beverage pod filling machine so as to allow the beverage pod filling devices 100 of the present disclosure to be used in a countertop-type setting. Accordingly, in some aspects, the beverage pod filling device 100 is not configured with a vacuum sealing or nitrogen purge capability.

A significant feature of some implementations of the present disclosure is the "ready to use" or "on demand" feature. In this regard, the filled beverage pods can be generated in quantities that can be consumed in a relatively short time period. In use, the beverage material incorporated in the beverage pod would be subject to deterioration if stored for an extended period of time due to at least the contact of the beverage material with air when placed into the beverage pod. For prior art beverage pods that are not subjected to air or nitrogen purge, one or a plurality of the filled pods are generally packaged in an airtight or nitrogen purged package that is sealed prior to use by a consumer. Such packaging is typically used in an inline or rotary packaging device. Yet further, the beverage pod filling device 100 provides a beverage pod filled with beverage material, wherein the filled beverage pod is not subjected to either or both of vacuum treatment or nitrogen purging in the filling and sealing operation. In a still further aspect, the combined beverage pod container bottom and an associated lid are not configured for preventing air from contacting beverage material contained therein.

Further in order to facilitate the small footprint of the filling device 100, the beverage material filling device 100 does not comprise a heat sealing element, such as would be used to affix a lid to the beverage pod via a thermally activated film. Yet further, the filling device 100 does not comprise an adhesive dispensing or application element to affix the lid. Accordingly, the lidded and sealed filled beverage pod does not comprise a seal generated from heat sealing or adhesive applied to affix the lid to the beverage pod. Instead, any covering (with or without adhesive on either or both of the pod rim or the covering material) included on a lower or upper side of the lid frame will be applied prior to stacking of the lids in the filling device 100.

Commensurate with the countertop configuration of the present disclosure, is it generally not intended that the filled beverage pods be generated in large quantities, that is, more than about 4 or 8 or 12 or 16 filled beverage pods per minute, as would be required in a commercial operation. In some aspects, the beverage pod filling device 100 is configured to generate a maximum of about 18 or fewer, or about 12 or fewer, or about 8 or fewer filled beverage pods per minute.

To further facilitate maintaining the small footprint of the beverage pod filling device 100, a supply of beverage pod containers is configured to nest as a plurality of unfilled beverage pod containers in the filling device 100. Still further, the beverage pod container lids are configured to stack. Such stacking/nesting in the filling device 100 is shown in FIG. 1G, for example, as 115 for the beverage pod containers 120 and 185 for the lids 180.

Figure 5:
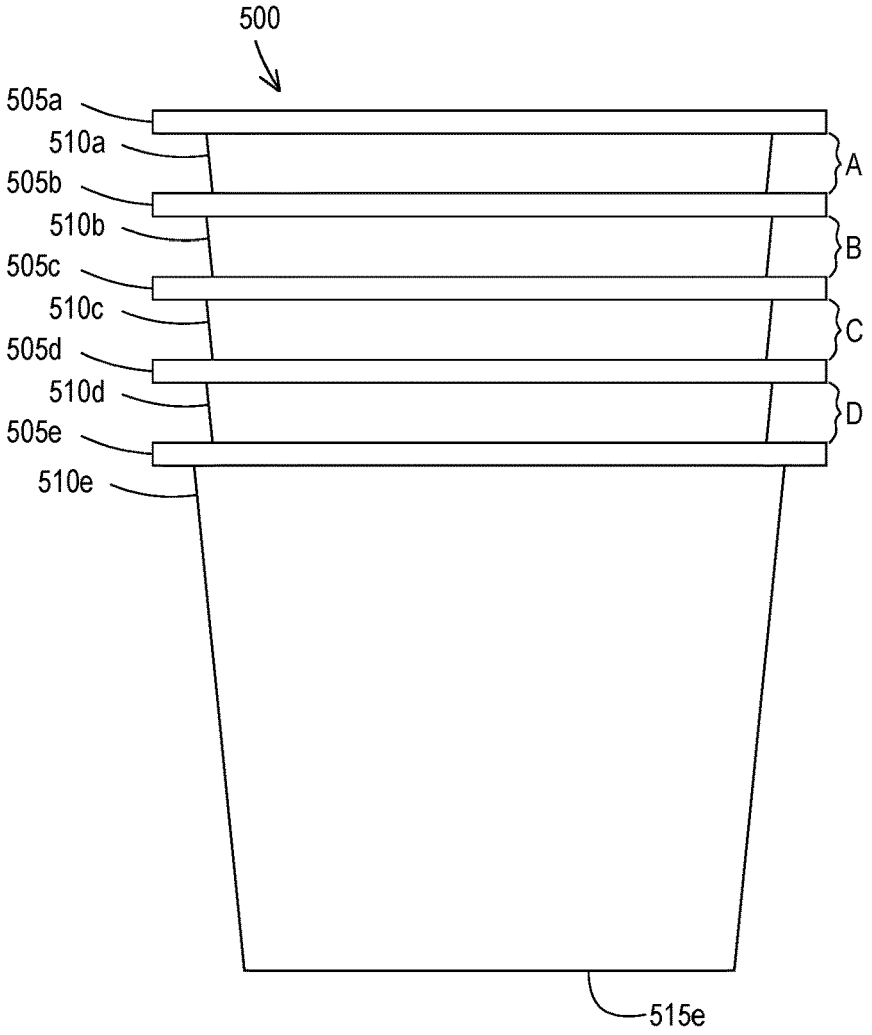
FIG. 5 illustrates an exemplary nested stack of beverage pod containers.

Referring to FIG. 5, which shows a nested arrangement of unfilled beverage pod containers 500, having rims 505*a*, 505*b*, 505*c*, 505*d* and 505*e* configured with outer sidewalls 510*a*, 510*b*, 510*c*, 510*d*, and 510*e*, respectively, and inner sidewalls, respectively (not shown). Each of the beverage pods in the nested beverage pod container assembly 500 has a bottom portion, here shown as 515*e* in the lowest container, which is pierceable by a needle in a single serve brewer if the pod comprises a solid outer covering. As would be recognized, the remainder of sidewalls 510*a*-510*d* are nested in each of a corresponding lower beverage pod to be in contact with the respective inner sidewall. In use, each independent distance A, B, C, and D between each of the rims 505*a*-505*e* in a nestable stack is approximately equidistant to facilitate operation of the beverage pod container separator 110 in the beverage pod filling device 100 as discussed further herein.

In significant aspects, the unfilled beverage pod containers are not advanced into the filling device 100 for filling in a linear alignment as illustrated in US Patent Publication No. 20170210498, the disclosure of which is incorporated herein in its entirety. Still further, the orientation of the unfilled beverage pod containers and lids in the inventive beverage material filling device 100 can consist essentially of respective nested assemblies as set out in more detail herein.

At least about 2, about 4, or at least about 6, or at least about 8 or at least about 10 or at about least about 12 or about 24 or more unfilled beverage pod containers can be configured as a nested assembly, that is, are stacked, for use in the beverage material filling device 100, as shown, for example, in FIG. 1A as 115. Such stacked container assembly can be configured for storage in a beverage pod package or in the container delivery chute fixed or engagable in the beverage pod filling device 100. The stacked assembly of unfilled beverage pod containers can be packaged to allow the package itself to be engageable with the beverage pod container delivery chute, such as by removably engaging a package in which the beverage pod containers are stored with the container delivery chute for use. The wrapping or package in which the unfilled beverage pod containers can be provided for use can be configured as a cylinder or as a rectangular package having a container delivery chute engagement end configured to removably engage with the container delivery chute (e.g., screw fit, friction fit, etc.). The package can be made from either or both of a plastic or paperboard material. The unfilled beverage pod containers can also be removed from a package and directly placed in the container delivery chute by a user. Whether an engageable package or removable wrap is used to deliver the stackable assembly of unfilled beverage pod containers or the stackable assembly is configured in the container delivery chute by a user, the unfilled beverage pod container (storage and) delivery chute is configured to maintain the unfilled beverage pod containers in a clean and sanitary condition prior to use. In this regard, when in operational engagement with the beverage pod filling device 100, the stackable assembly of beverage pod containers is not proximal to the countertop or other working area that may come into contact with bacteria, dirt, etc.

Notably, it has been determined that disengagement of an unfilled beverage pod container from the stack can be facilitated by a beverage pod container separator that is configured to urge the lowest container in the stack from the container above. In this regard, in use, it has been found that the lowest pod container in the stack of pods will often become stuck and difficult to release consistently onto the belt(s) for dosing thereof. Without being bound by theory, it is hypothesized that the collective weight of a plurality of unfilled beverage pod containers in a stack can exert pressure on one or more of the lower pod containers. Such pressure can make it difficult to separate the lowest container from the stacked configuration without also applying some separation force (e.g., an "urging" force) to assist in separating the lowest container from the nested stack configuration. Such beverage pod container separation functionality is discussed hereinafter with regard to FIGS. 11A-11F.

Figure 6:
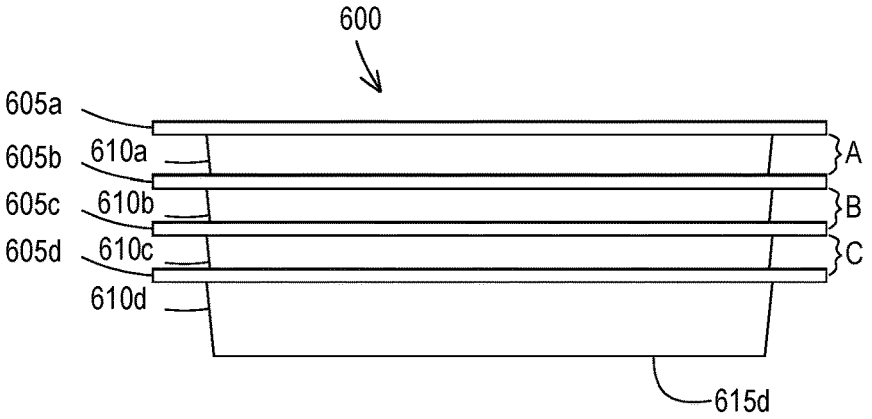
FIG. 6 illustrates an exemplary nested stack of beverage pod lids.

Referring to FIG. 6, a stacked lid assembly 600 is provided, wherein each of the rims 605*a*, 605*b*, 605*c*, and 605*d* is configured with a sidewall 610*a*, 610*b*, 610*c*, and 610*d*, as shown. In the stacked lid assembly 600, the distance between rims A, B, and C are approximately equidistant so as to facilitate delivery of the lowest lid to an associated beverage pod container from the lid separator according to the functionality discussed hereinafter. A lid bottom 615*d* of the lowest lid is shown in FIG. 6, and it is to be understood that each of the lids in stacked assembly 600 has such a configuration, as discussed further herein. In one aspect, the stacked lid assembly 600 comprises a lid that is not connectably attached to the unfilled beverage pod container prior to the lidding/sealing step. In this regard, the lids can be stackably assembled in a lid delivery chute. The lid delivery chute is configured drop a single lid onto a filled, but unsealed, beverage pod container aligned below the lid delivery station.

As with the beverage pod containers, the lids can be packaged to allow the package to be engageable with the lid delivery chute to allow the lids to be directly loaded into the filling device 100. For example, in FIG. 1F, the loaded stackable assembly of lids 185 is shown. A plurality of lids 180 is configured in a stackable assembly 185 in the lid delivery station. Delivery of the lids from the lid delivery station is discussed hereinafter in relation with respect to FIG. 17.

Figure 7:
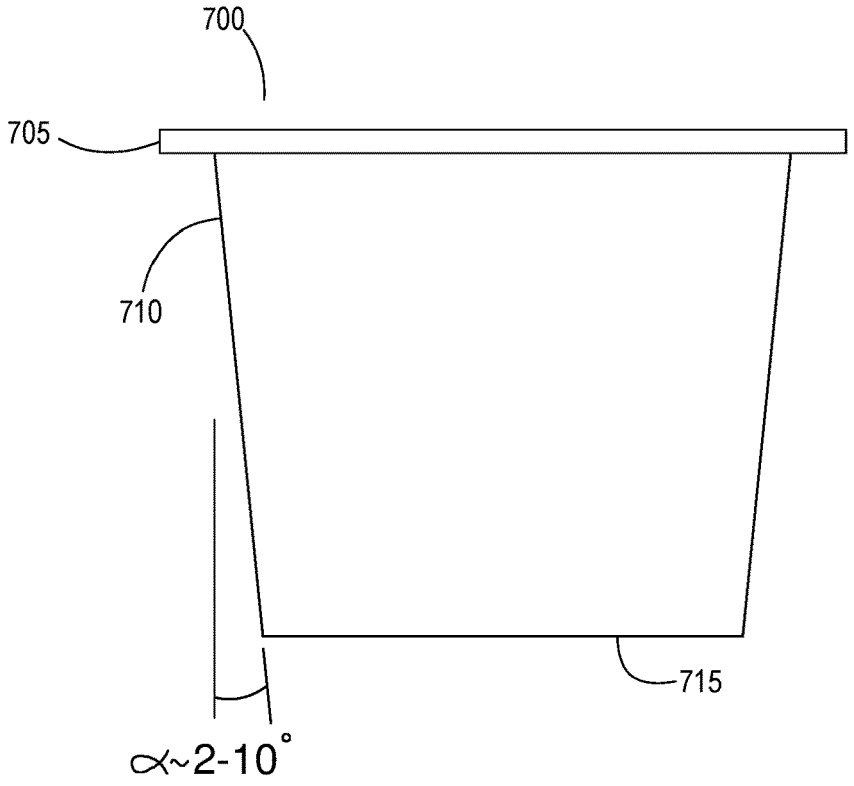
FIG. 7 illustrates an exemplary beverage pod container.
Figure 8:
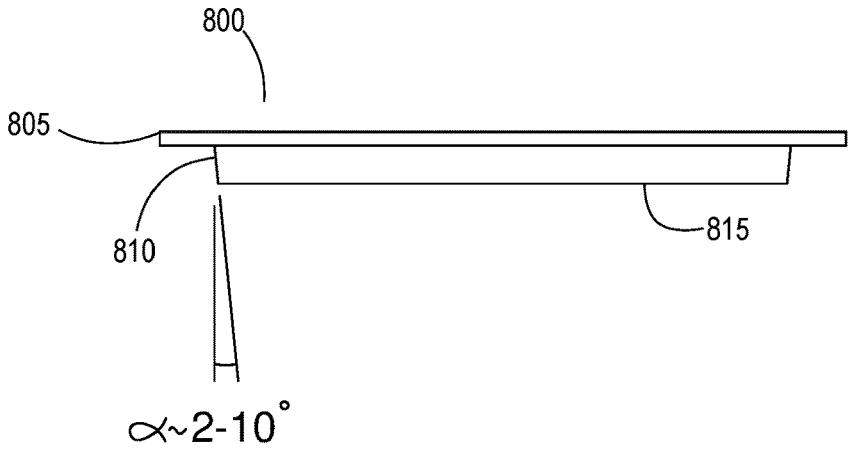
FIG. 8 illustrates an exemplary beverage pod lid.

A significant aspect of the present disclosure is the complementary fit of the beverage pod container with an associated lid. Referring to FIG. 7, beverage pod container 700 comprises a rim 705, sidewall 710, bottom 715, and inner wall (not shown). Sidewall 710 and inner wall (not shown) are configured with angle alpha ($\alpha$) of from about 2 degrees to about 10 degrees. Referring to FIG. 8, a lid 800 comprises a rim 805, sidewall 810, bottom 815, and the inner wall (not shown). Sidewall 810 is configured to have angle alpha ($\alpha$) of from about 2 degrees to about 10 degrees.

The angles alpha ($\alpha$) for the beverage pod container and lid are substantially equivalent so as to allow a tight complementary fit to be provided once pressure is applied to the lid by, e.g., a lid fixing component as the lidded beverage pod is transported along the belt(s) to exit the beverage pod filling device 100 as discussed hereinafter. Such substantial angular equivalence has been found to facilitate the ability to generate a friction fit that is sufficient to create a durable seal for the intended use of the filled beverage pod.

With respect to the sidewall and inner wall angular configuration, it has been determined that delivery of the lid from the lid delivery chute onto a beverage pod container at the lid delivery station can be facilitated by incorporating a tapered complementary fit between each of the lid and the beverage pod container having the beverage material dosed therein. Moreover, the specific angle (a) of about 2 degrees to about 10 degrees for the sidewall taperings for each of the beverage pod container and lid has been found to allow the lid to generate an improved alignment in a top portion of the beverage pod container when the lid is dropped from the lid delivery chute onto the filled but unlidded beverage pod container. In use, when a filled beverage pod container is substantially aligned with a bottom portion of the lid delivery chute, which can be facilitated by the indexed movement of the belt(s) and/or use of sensor functionality as discussed herein, the sidewall 810 will engage with the beverage pod container inner wall (not shown) via a friction fit. It has been found that either an angle of less than about 2 degrees or an angle of greater than about 10 degrees in each of the lid and the beverage pod (where the beverage pod container angle is measured from an opposite direction as would be recognized) can provide a lesser probability that sidewall 805 will suitably engage with the beverage pod container inner wall (not shown) when delivered from the lid delivery chute. In this regard, when the specified taper angle range is used in the respective tapered lid and beverage pod components, the lid can be delivered from the delivery chute to fit substantially within the opening of the beverage pod container to allow the lid to be seated thereon in a subsequent lid fixing step.

Figure 9A:
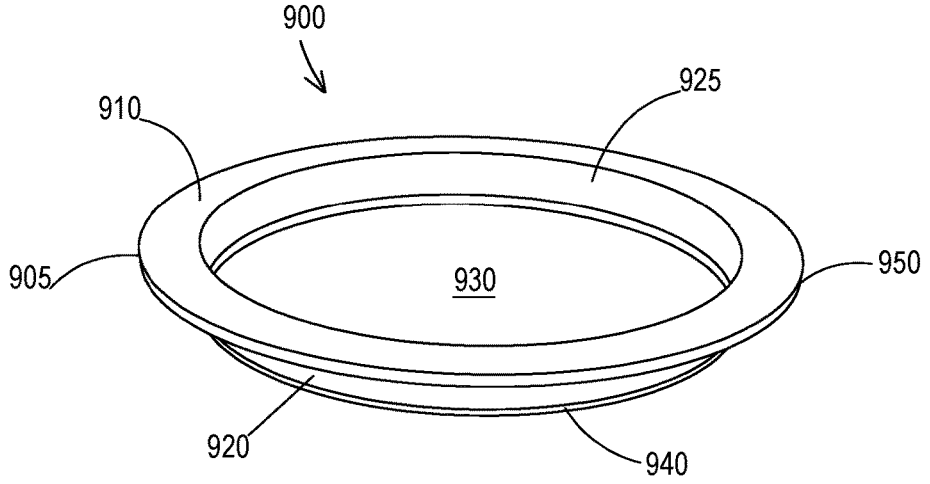
FIGS. 9A and 9B illustrate an exemplary beverage pod lid configuration.
Figure 9B:
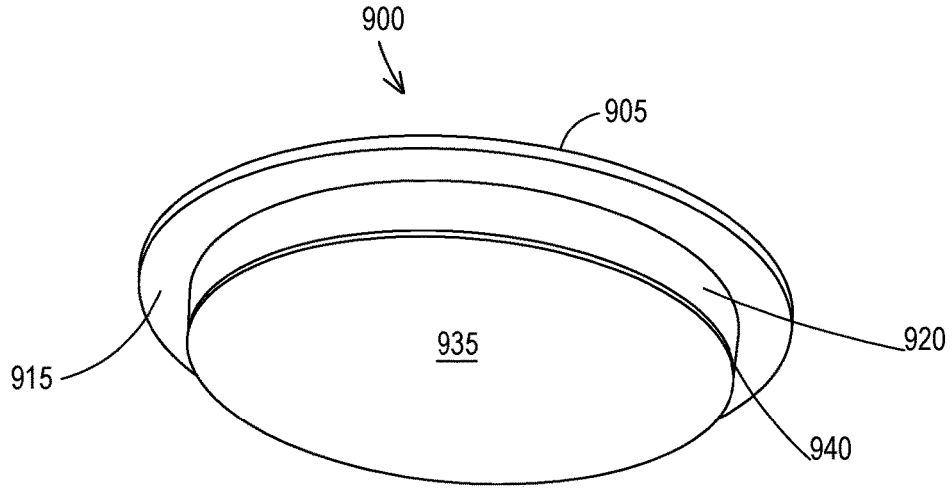

Referring to FIGS. 9A and 9B, perspective views of a lid 900 is shown from above (FIG. 9A) and below (FIG. 9B), with the rim edge 905, rim top side 910, rim bottom side 915, outer sidewall 920, inner wall 925, upper side 930, and lower bottom side 935, where 930 and 935 are the upper and lower side of an attached lid cover, as discussed further herein. As shown in FIGS. 9A and 9B, the upper covering side 930 can be affixed to the bottom 940 of the sidewalls.

The material forming the lid covering—that is, bottom portions 930 and 935—can comprise a polyethylene, foil, polypropylene, or other pierceable material.

Figure 10A:
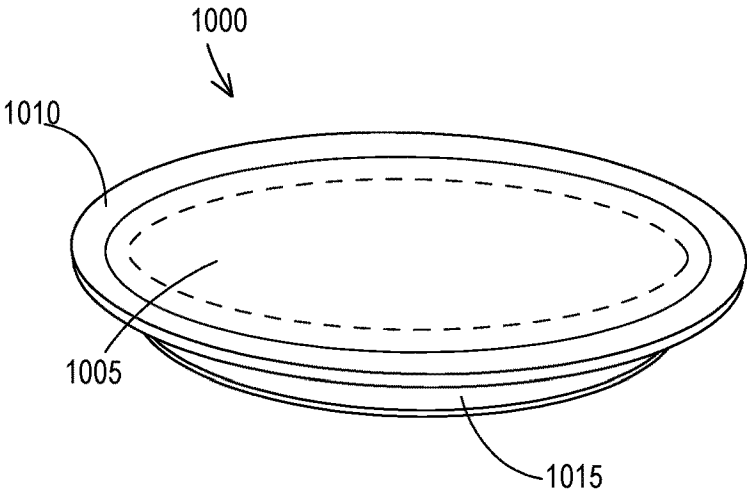

Referring to FIG. 10A, lid 1000 has a cover 1005 affixed to the top rim surface 1010. Lid 1015 has outer sidewall 1015. Viewing lid 1000 from a bottom perspective in FIG. 10B, the cover bottom 1020 is visible. As shown, lid 1000 is stackable in a delivery chute.

As shown in FIGS. 9A-9B and 10A-10B, a covering can be at a bottom or top side of the lid rim. Alternatively, the entire lid can be comprised of a solid material, that is, to form a solid plug, in some implementations.

Unlike the lids that are disclosed in U.S. Pat. No. 9,527,661, the disclosure of which is hereby incorporated by reference in its entirety, the lids of the present disclosure do not comprise a configuration wherein a portion of the lid is engaged over a top portion of the sidewall of the beverage pod container to provide a cover for the top rim of the beverage pod. In other words, the lids of the present disclosure are not configured to cover the top portion of the beverage pod container sidewall to engage with the outer sidewall portion as a covering. Instead, the lids of the present disclosure are configured to form a friction fit within and between the outer sidewall of the lid and the top portion of the inner sidewall of the beverage pod container. In this regard, the outer sidewall portion of the lids are configured to engage with an inner rim portion of a beverage pod container to form a complementary fit thereof. In this regard, the lid configuration of the present disclosure serves to "plug" the beverage material in the container via a friction fit, as opposed to covering the container solely via a polymeric or other type of seal. Still further, the lid is not attached to the beverage pod container via a hinge.

In a further implementation, a beverage pod with an integrated lid can be used, such that the lid is attached to the beverage pod container via a hinge. As would be recognized, a beverage pod container with an integrated lid will not require a lid delivery station. The configuration of the lid delivery station will have to be modified to accommodate the differently configured beverage pod configuration. However, the beverage pod container separator functionality as discussed hereinafter would still be relevant.

As mentioned previously, it has been found that the stacked beverage pod container configuration can result in the lowest (or bottom) beverage pod container in the stack becoming difficult to disengage for use. Accordingly, it has been determined that by applying at least some force proximate to the rim of the lowest beverage pod container in the stacked—that is, nested—assembly suitable separation can occur. In other words, the container separator should be configured to urge the top rim of the lowest beverage pod container in the stack away from the remaining containers in the stacked assembly.

Figure 11A:
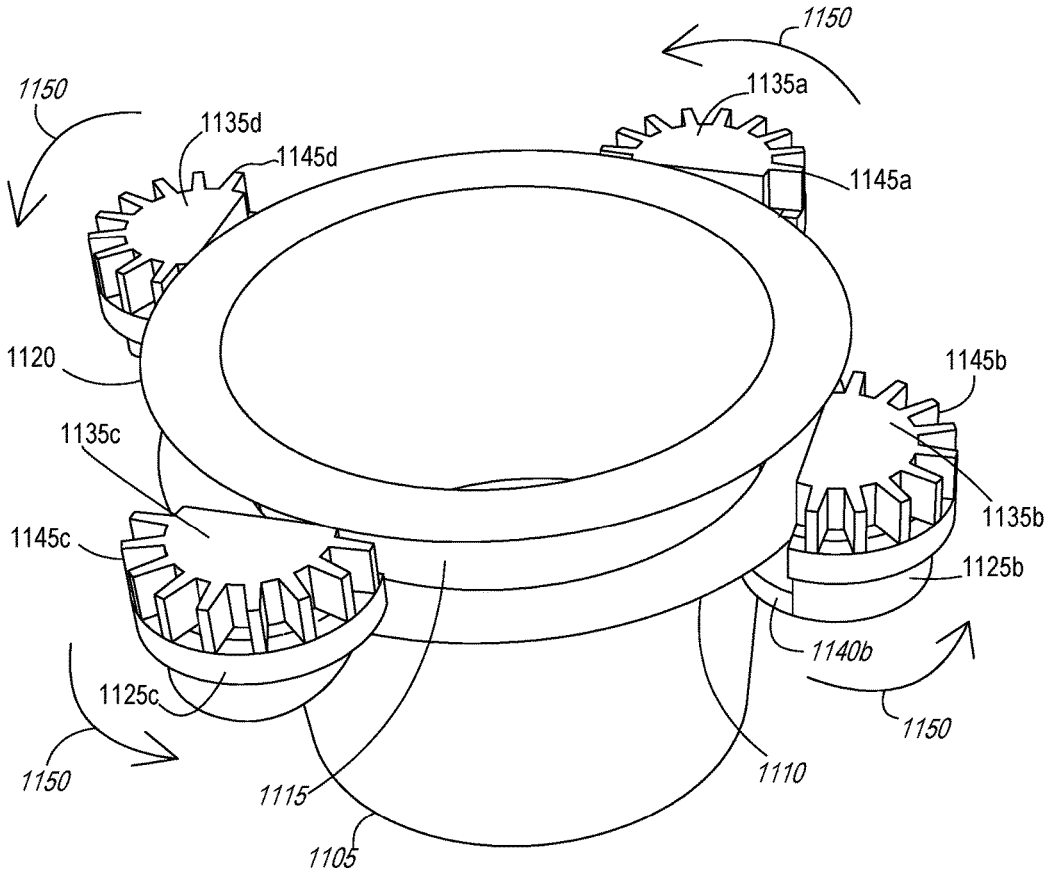
Figure 11B:
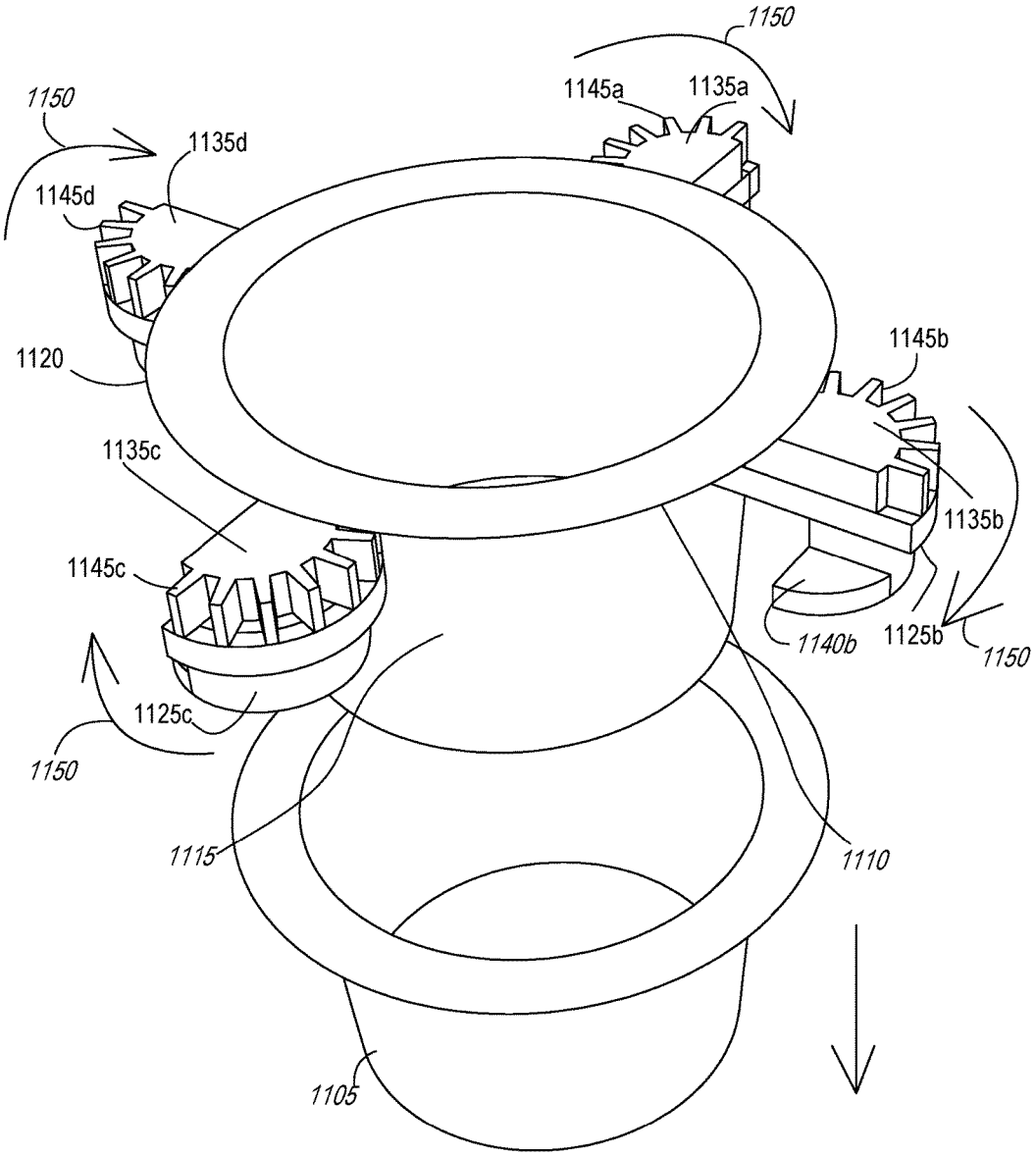
Figure 11C:
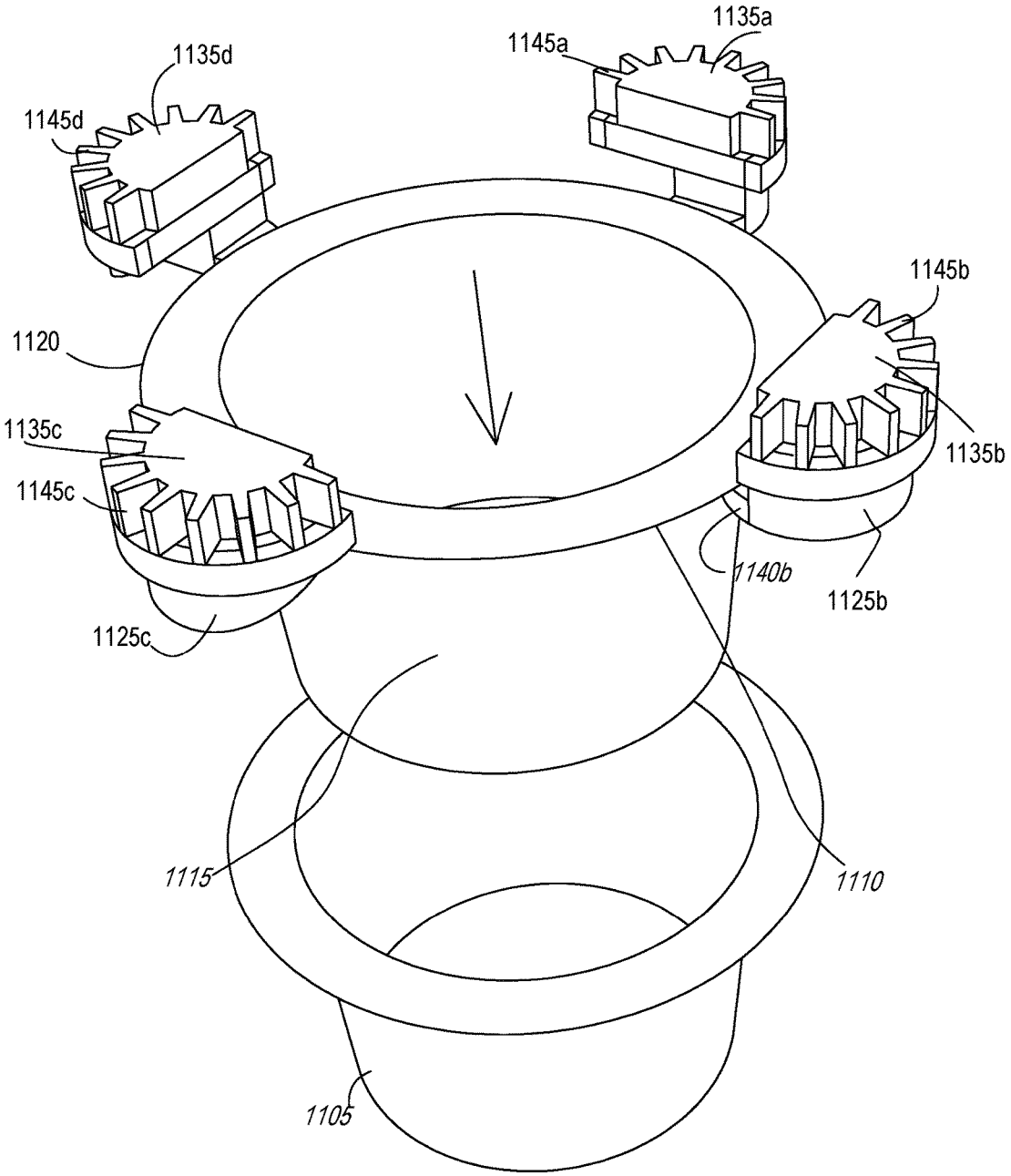
Figure 11D:
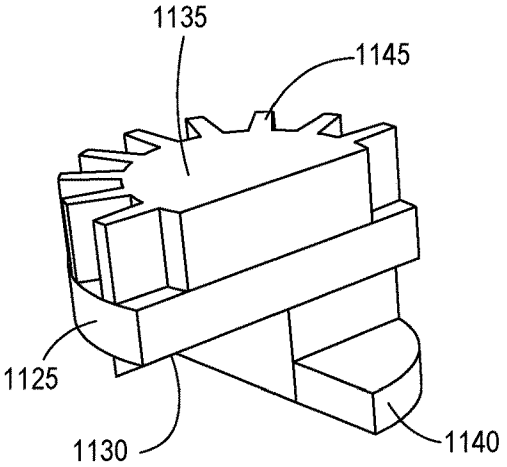
Figure 11E:
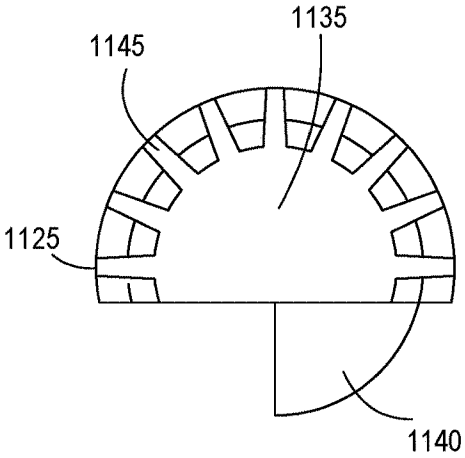
Figure 11F:
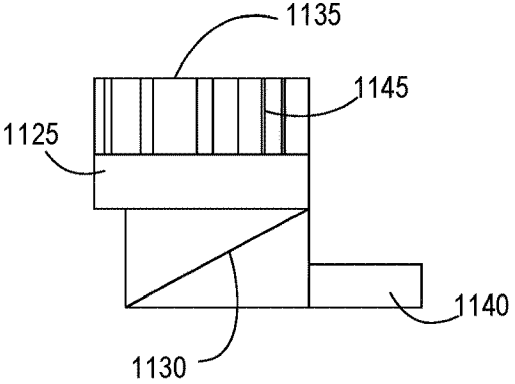

An exemplary beverage pod container separator is illustrated in FIGS. 11A-11F. As shown in FIG. 11A, the beverage pod container separator configuration 1100 supports at least a lowest (or bottom) beverage pod container 1105 having rim 1110. (The beverage pod container chute 105 is not shown, but the beverage pod containers will be stackably engaged therein as shown, for example, in FIGS. 1A-1G). Beverage pod container 1105 is in stacked engagement with upper beverage pod container 1115 having rim 1120. The beverage pod container separator componentry is shown in FIGS. 11A-11C with a plurality of cams 1125*a*-1125*d* distributed about the rims 1110 and 1120 of the containers 1105 and 1115. For example, there can be two, three, four, five or more cams 1125 distributed about the containers 1105 and 1115. To provide for a uniform separating force on the lowest container 1105, the cams 1125 are equally or uniformly distributed about the containers 1105 and 1115. As can be seen in the example of FIGS. 11A-11F, the cams 1125 include a tapered portion (or ramp) 1130 at the bottom of the cam 1125, a top surface 1135 that can be substantially perpendicular to the axis of rotation of the cam 1125, a lower support finger (or tab) 1140 that extends outward from a bottom surface of the cam 1125 (opposite the tapered portion 1130), and a spur gear portion 1145 adjacent to the top surface 1135 of the cam 1125. FIGS. 11D-11F provide perspective, top and side views of the cam 1125, respectively. The spur gear portion 1145 of each cam 1125 engages with an internal ring gear (see FIGS. 1A-1G) extending around the beverage pod container separator 1100. All cams 1125 engaged with the internal ring gear can be rotated in unison by rotating the internal ring gear using, e.g., a stepper motor.

When at rest, the cams 1125*a*-1125*d* are all rotated such that the lower support fingers 1140*a*-1140*d* are positioned under the rim 1110 of the lowest container 1105. In this configuration, the weight of the stacked container assembly is supported through the rim 1110 by the lower support fingers 1140*a*-1140*d*. When all four cams 1125 *a*-1125*d* are rotated (e.g., by rotating the internal ring gear), for example, in a counter-clockwise rotation as shown by the arrows 1150 in FIG. 11A, the lower support fingers 1140*a*-1140*d* are rotated out from under the rim 1110 of the lowest container 1105 in the stack while the top surfaces 1135*a*-1135*d* are rotated under the rim 1120 of the upper container 1115. As the cams 1125*a*-1125*d* continue to rotate, the lower support fingers 1140*a*-1140*d* move clear of the rim 1110 and the top surfaces 1135*a*-1135*d* assume the weight of the stacked containers via rim 1120. By continuing to rotate the cams 1125*a*-1125*d*, a ramp 1130*a*-1130*d* (shown as 1130*c* in FIG. 11B) applies a downward force on rim 1110 while the upper surfaces 1135*a*-1135*d* continues to support the remaining containers in the stack. The ramps 1130*a*-1130*d* force rim 1110 away from rim 1120, and the lowest container 1105 is moved away from the upper container 1115 in a downward direction, separating it from the container stack assembly as illustrated in FIG. 11B. In this configuration, the top surfaces 1135*a*-1135*d* of the cams 1125*a*-1125*d* have rotated under the lip 1120 of the upper container 1115, preventing any other beverage pod containers above the cams 1125 (if any) from dropping at the same time that container 1105 drops to the belt(s) 135 (FIGS. 1A-1H). The profiling of the cam 1125 in the form of a downwardly sloping ramp as shown by 1130*c* (as illustrated in the side view of FIG. 11F) converts the rotation of the cam 1125 into a linear motion, thereby driving the lowest container 1105 in a downward direction. This allows a single pod container to drop to the belt(s) 1135. In other implementations, the ramps 1130 may be tapered to apply an upward force on rim 1120 that lifts the stacked containers from the lowest container 1105, allowing it to separate from the stack and drop downward. The cams 1125 are configured to rotate to a location that is less than about 300 degrees from a starting point, as measured by the 360 degree circumference of each cam 1125.

Once the container dropping step is complete, the cams 1125*a*-1125*d* can rotate in a reverse direction, here clockwise, moving the lower support fingers 1140*a*-1140*d* into position under the rim 1120 of container 1115, which is now the lowest container in the stack assembly. At the same time, the top surfaces 1135*a*-1135*d* are moved out from under rim 1120. This allows the now lowest pod 1115 to descend below the top surface 1135 of the four cams 1125*a*-1125*d*. With the top surfaces 1135*a*-1135*d* clear of the rim 1120, the stack of containers drops until the rim 1120 of container 1115 is supported by the lower support fingers 1140*a*-1140*d* as shown in FIG. 11C. The ramp profile (FIG. 11F) can be configured to allow for a vertical separation between pod rims 1110 and 1120 of from about 1/16 of an inch to about 1/4 of an inch. While four cams are shown in FIGS. 11A-11C, more or fewer cams can suitably be used, as long as suitable separation of a nested stack of pod containers can be achieved. For example, 2, or 3, or 4, or 5, or 6 cams can be arranged proximate to the beverage pod container delivery chute.

In a further implementation of the beverage pod container separator, the container separator can be configured to engage with at least a portion of the rim of the lowest unfilled beverage pod container in the stackable assembly. In this regard, the beverage pod container separator can be configured to allow the beverage pod containers to pass through an opening to reach the indexing belt(s). A container rim support can be configured having an opening diameter that slightly wider than the largest diameter on a vertical sidewall of the unfilled beverage pod containers, but having a smaller diameter than a diameter of a top rim of the unfilled beverage pod containers. Engagement of the opening with a lower side of the rim of the lowest unfilled beverage pod in the stackable assembly allows all of the unfilled beverage pod containers in the stack to be supported substantially by the rim of the lowest unfilled beverage pod. Upon activation by a signal, the support for the lowest container rim can be removed by separation or opening of the rim support to create an opening that is larger than the rim diameter. The unfilled beverage pod container can then drop by gravity to the indexing belt(s). Once an unfilled beverage pod container is released onto the indexing belt(s) for movement to the other stations, the rim support can close quickly enough to allow reengagement with the lower surface of the rim of the next unfilled beverage pod container in the stack prior to a further container being released onto the indexing belt(s). The rim support will remain closed until a signal is received to release the next unfilled beverage pod container in the nested stack. The container delivery chute is positioned above the indexing belt(s) to allow the dispensed container to drop onto the indexing belt(s) while the next beverage pod container is engaged by the rim support.

In a further implementation, a ramp separator can be used to separate the lowest unfilled beverage pod container from the nested stack. In this regard, the assembly support having at least some lateral movement and at least some diagonal movement associated therewith can be configured to allow the lowest unfilled beverage pod container to be removed from the assembly. Such motion will suitably apply torqueing force, if needed. The interior of the assembly support can be further configured to allow a single unfilled beverage pod container to be laterally slid along the support along the lower side of the rim to be released through an opening on an end of the support onto the indexing belt, wherein the opening has a larger opening than the diameter of the rim. Such lateral movement of the assembly support can be generated and timed according to a generated signal configured to allow only a single unfilled beverage pod container to be delivered to the indexing belt(s) at one time.

The compact footprint of the filling device of the present disclosure can be facilitated by configuring the various stations in the filling device (i.e., container delivery, material delivery (or dosing), lid delivery, and/or pod ejection) to be engagable by indexing/advancing of the pod containers along an indexing belt (or belts), as shown as 135 in FIGS. 1A-1H, for example. In one aspect, the indexing belt(s) can be configured as a split system, that is, two belt drives as illustrated in FIG. 1H, allowing the container to advance among the support rails on top of the belts while being supported by the rim of the container. In some aspects, this has been found to generate an overall lower profile for the filling device and eliminates the need for any support mechanisms to keep the beverage pod container upright. When the filled and lidded beverage pod is ready for exit from the filling device, this design can allow the pod to freely disengage itself without interference.

As discussed, the beverage pod container is advanced/indexed between the beverage pod container delivery station, the beverage material delivery (or dosing) station, the beverage pod lid delivery station, a lid fixing area that results from compression, and ejection via indexing on the belt conveyor system. Optionally, beverage material tamping and lid pressing stations can be incorporated. As would be recognized, a belt indexing system can comprise two or more pulleys, sprockets and/or drums arranged with a belt therein on a continuous loop that rotates around the pulleys, sprockets and/or drums. Either or both of the pulleys, sprockets and/or drums can be powered. The belt(s) can be, for example, made from, for example, polyester, polyvinyl chloride, silicone, and polyethylene.

The belt(s) can be appropriately configured to be advanceable/indexable from station to station by use of a cogged or toothed structure, wherein the cogs/teeth are configured on an underside (or inner surface) of the belt(s), for example. Such a cogged/toothed structure has been found to maintain the beverage pod containers advancing in a synchronized fashion from station to station in the filling device. In other words, appropriate timing of the movement of the beverage pod container between the various stations has been found to be facilitated with this indexing belt configuration. In some configurations, the belt(s) can comprise nodes, indentations, or raised areas in which the bottom rid or the outer circumference of the containers can engage or nestle, such as by seating therein, thereby reducing the propensity of the container from slipping or moving on the belt(s) while being advanced. For example, the indexing belt(s) can comprise a plurality of openings sized to allow all or part of the sidewall of a beverage pod container to seat therein for each of the subsequent operations after the beverage pod container delivery step. When the filled and lidded beverage pod reaches the end of the belt(s), the rotation of the belt(s) about the pulley(s), sprocket(s) and/or drum(s) will result in the filled and lidded beverage pod being delivered to a user by ejection or other removal thereof from the belt. Yet further, the indexing belt can comprise a rim or a plurality of nubs providing a raised area on the belt that is slightly larger than the bottom of the beverage pod. Such raised area can assist in keeping a beverage pod appropriately positioned on the belt for operations subsequent to the delivery of the beverage pod to the belt.

The operation of the cogs/teeth, and therefore the belt(s), can be engaged with the operational aspects of the stations, that is, the beverage pod container delivery station, the beverage material delivery (or dosing station), and the beverage pod lid delivery station. Such operational engagement can be via communications between these elements via a microprocessor control, as discussed hereinafter. To better ensure that the pod containers are suitably engaged for filling and lidding, sensors can be configured in the device proximate to one or more stations to confirm that a container is suitably engaged and positioned with respect to each station. For example, such suitable engagement in relation to the beverage material delivery station can substantially prevent any spillage of the beverage material outside of the beverage pod container. Positional sensors (e.g., proximity, infrared, light, etc.) can be used to ensure that the containers are in the proper location for operation of the stations and ensure timing of the containers with each other and to detect or prevent slippage.

The indexing belt(s) can be configured so that the timing of the advancement from one station to the next will allow completion of each stage. In this regard, the indexing belt is configured to allow the belt(s) to stop for a defined period of time (e.g., about 2 or 3 or 5 or 7 or 9 or 15 or 30 seconds) at each station before initiating movement of the container(s) to the next station. For example, if filling the container is the slowest station, the belt(s) can be stopped for a period of time sufficient to ensure that dosing of the beverage material is complete before advancing the belt(s), and thus the container(s).

Turning now to the beverage material delivery (or dosing) station B, after an unfilled beverage pod container is delivered from the stackable assembly and provided on the indexing belt for advancement, the beverage pod filling device is configured to dose the beverage material in a filling operation at the beverage material delivery station, where the beverage material is introduced into an unfilled beverage pod container via volumetric filling by dispensing of the beverage material from a containment hopper in operational engagement with the dispensing system.

In some implementations, the beverage material containment hopper is configured to be removably engageable from the beverage pod filling device. The beverage material containment hopper can be engageable the beverage pod filling device by screw fit, internal or external friction fit, clamp fit, linear slides or other appropriate mechanical engagement. The beverage pod filling device can comprise a track or alignment sensor to facilitate proper engagement of the beverage material container with the beverage pod filling device. The filling device can be configured with a "lock-out" function so that a beverage pod filling operation cannot be commenced until a signal is received that the engagement of the containment hopper is completed. The containment hopper can be communicatively coupled and removably engaged with the beverage material delivery station.

To maintain the freshness of the beverage material, once the beverage material containment hopper is engageably fit with the beverage pod filling device, a seal between the filling device and the beverage material containment hopper can be substantially airtight. The beverage material containment hopper can be sealable with an associated lid, as described previously. The beverage material containment hopper can be constructed from food grade plastic material such as, e.g., polyethylene, polycarbonate, or from a metal such as, e.g., stainless steel or aluminum. In some aspects, a plurality of beverage material containment hoppers can each be removably engageable with the beverage material delivery station. For example, each of the plurality of engageable hoppers can be configured to provide storage of different beverage materials to allow a user to change out the beverage material as desired. This can allow the user to select a beverage material to be used in filling the beverage pod in a filling operation. In this regard, the engagement between the beverage material containment hopper and the filling device can substantially prevent the beverage material from coming into contact with surfaces on the filling device where other beverage material has come into contact. This can reduce the possibility of cross-contamination such that beverage material residue will substantially not be present on the filling device after the beverage material filling operation is complete.

The beverage material can be dosed into each unfilled beverage pod container via a volumetric filling operation through an opening in the bottom of the containment hopper. In one implementation, a sliding or blocking component can be in operational engagement with the bottom opening in the containment hopper. Such sliding or blocking component can be in a linear or in a rotational configuration to provide the filling operation. As would be recognized, such configurations can discharge a volume of beverage material as a function of time or volumetric chamber size, here the amount of time the sliding or blocking plate generates an opening through which the beverage material can move from the bottom of the containment hopper to the unfilled beverage pod bottom. Upon alignment of an unfilled beverage pod container below the closed containment hopper opening, the sliding or blocking component can be actuated to create an opening in the bottom of the containment hopper so that the beverage material in the chamber will flow into the beverage pod via gravity.

Figure 12:
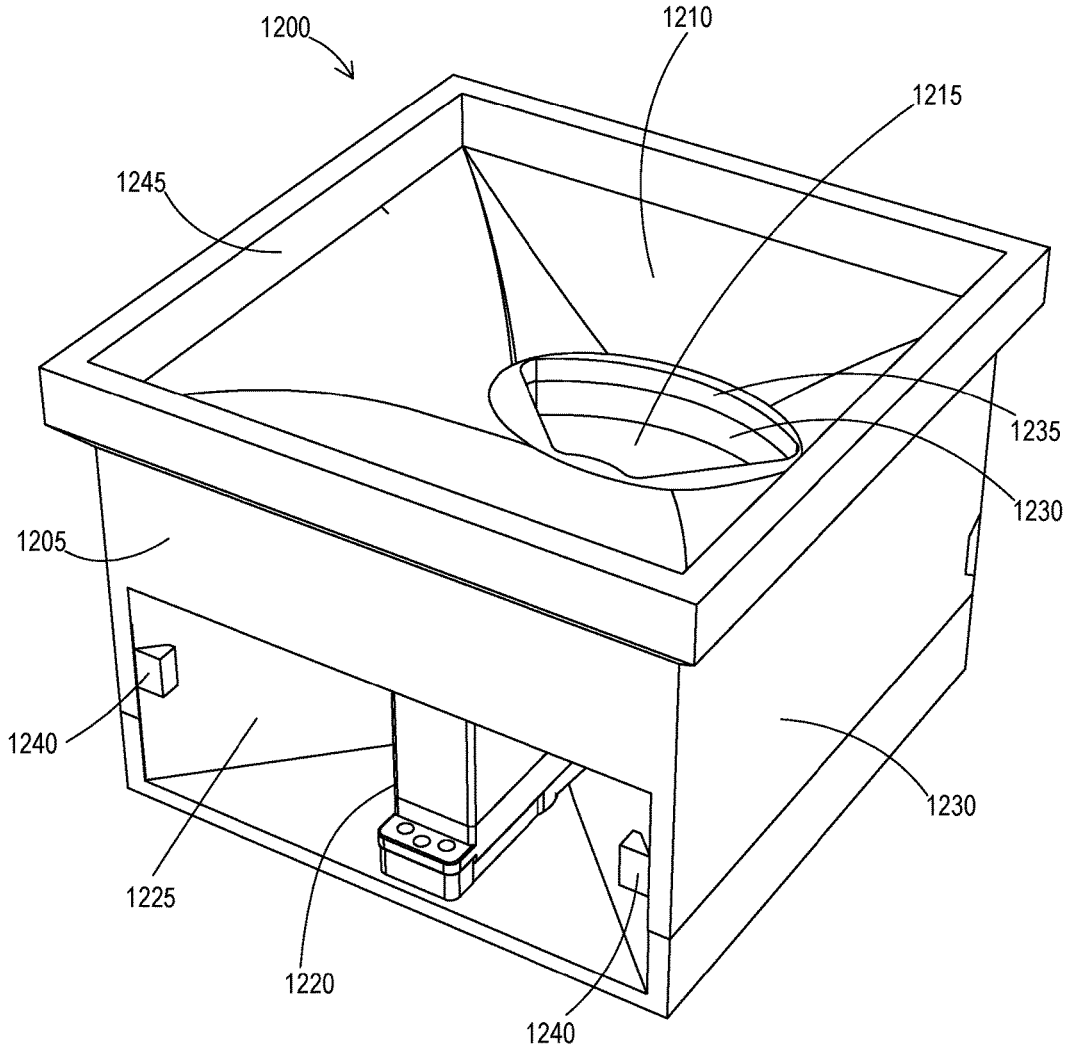
FIG. 12 illustrates a beverage material containment hopper.

Once the beverage pod is in substantial alignment with the beverage material delivery station, the filling of the beverage pod can commence. As shown in FIG. 12, beverage dosing component 1200 comprises a containment hopper base 1205, having an interior 1210, which can be sloped as shown. Vertical walls of the containment hopper (see, e.g., 1605 of FIG. 16) can extend upward from the containment hopper base 1205, for holding the beverage material (not shown), and sized to contain up to one pound or more of beverage material (ground coffee, cocoa, etc.). Suitable beverage material capacity of the containment hopper 1205 can be about 1 pound, or more or less. Such slopped interior, which is oriented toward opening 1215, can facilitate gravity feeding. While opening 1215 is advantageously configured to one side the containment hopper 1205 as shown, the opening can be positioned elsewhere in the interior 1210, as long as the other components of the beverage dosing component 1200 are suitably in alignment therewith. As shown, an opening actuator 1220 (e.g., a motor or solenoid) is shown in space 1225 for operational engagement with a dosing block 1230 partially shown with the dosing plate 1235 in an open configuration. The opening actuator 1220 can be placed elsewhere to accommodate a range of dosing plate configurations, as discussed hereinafter. In use, the opening actuator 1220 will be secured in space 1225, which has a door or cover (not shown) that can be secured over the access opening to the space by clips 1240, for example, or other fasteners. The opening actuator 1220 will therefore generally not be visible to or serviceable by a user, and will also be isolated from coffee debris. As shown, the containment hopper 1205 has an upper interior rim 1245 that facilitates a friction fit of a lid (not shown) to keep beverage material (not shown) clean and free of dust, dirt or pests during storage thereof, although other lid engagements can be suitably configured thereon.

Figure 13:
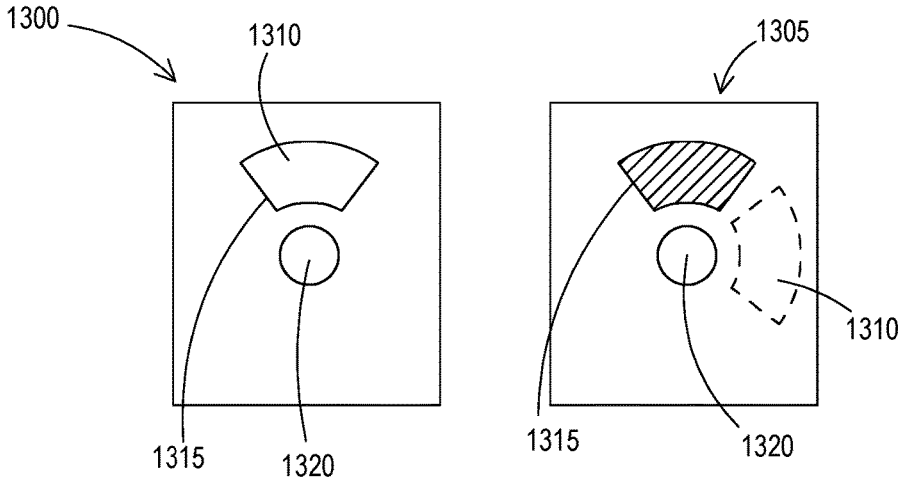
FIG. 13 illustrates a beverage material dosing plate and volumetric dosing block.

FIG. 13 illustrates an implementation of the beverage dosing component 1200 comprising rotating volumetric dosing configurations 1300 and 1305 from a bottom view. Configuration 1300 of FIG. 13 shows a volumetric dosing block 1310 aligned with dosing plate opening 1315 to dispense beverage material (not shown) therefrom. The dosing block 1310 can be configured to rotate about pivot point 1320. Configuration 1305 shows the volumetric dosing block 1310 rotated about 90 degrees to fill the volumetric chamber (not shown) with beverage material.

Figure 14:
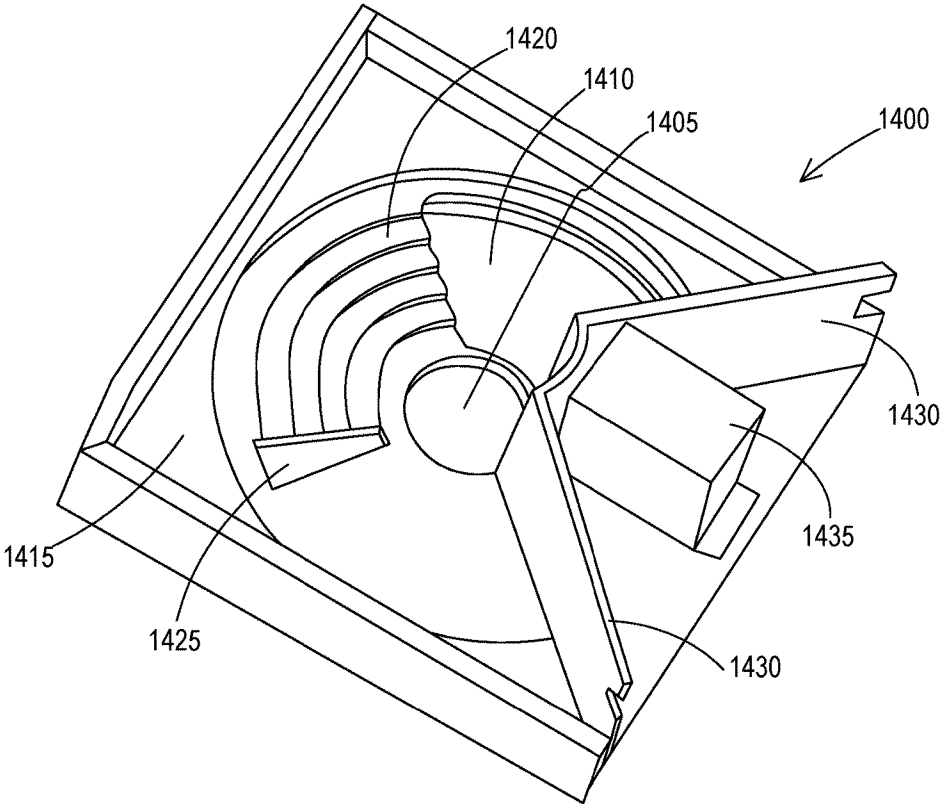
FIG. 14 illustrates a bottom view of a beverage material dosing plate.

FIG. 14 illustrates a further bottom view of a dosing plate 1400, along which a volumetric dosing block (not shown) can rotate about pivot point 1405. Dosing plate 1400 includes opening 1410 through which beverage material (not shown) from containment hopper (not shown) exits in use. Dosing plate bottom surface 1415 includes depressions or grooves 1420 so as to reduce the surface area that the dosing plate contacts with the dosing plate bottom 1415. Such depressions or grooves 1420 also allow any beverage material that have become stuck or adhered to the bottom surface 1415 to move along therewith to exit hole 1425 where such material can be reintroduced into a subsequent beverage material dosing operation. In the dosing plate 1400, optional support channels 1430 are incorporated, which can be omitted in some implementations. An actuator 1435 (e.g., a motor) drives the dosing block to the correct position for volumetric dosing of the beverage material, where such motor location can be suitably varied.

Figure 15A:
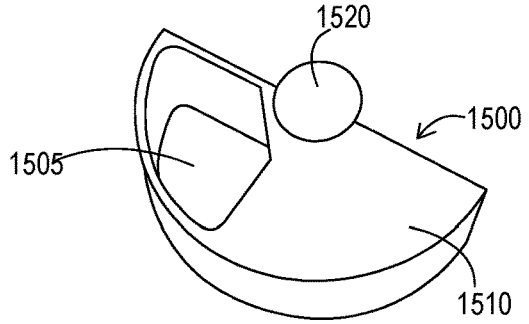
FIGS. 15A, 15B, and 15C illustrate different configurations of volumetric dosing blocks.
Figure 15B:
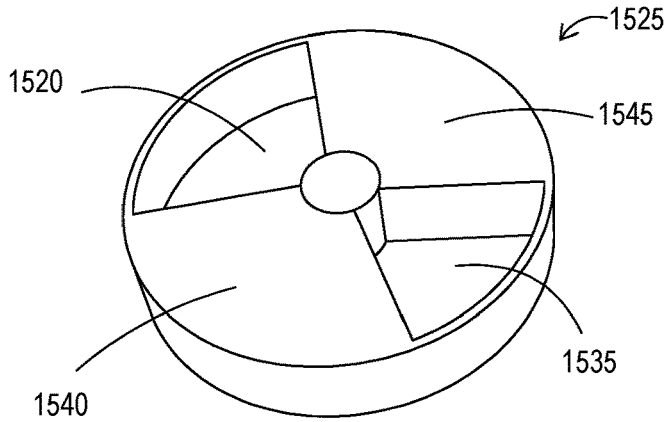

A dosing block configuration that can be implemented in FIGS. 13 and 14 is shown in FIG. 15A. Dosing block 1500 has a volumetric opening 1505, solid portion 1510 and pivot 1520. As shown, volumetric opening 1505 has height and width that is configurable to allow a defined amount of beverage material to be loaded therein for delivery in a dosing operation. FIG. 15B illustrates a two chamber dosing block configuration that can be configured with a suitable dosing plate configuration (not shown). As shown, dosing block 1525 has 2 volumetric filling chambers 1530 and 1535 and solid portions 1540 and 1545. Chambers 1530 and 1535 can be configured to provide differing volumes of beverage material filling, where such differing volumes are provided by the size of the respective openings, where the volume of beverage material dispensed in each opening is a function of the horizontal surface area, and the height of each chamber. Solid portions 1540 and 1545 will cover the dosing plate opening (not shown), and thus will be larger than the dosing hopper bottom opening so as to stop the flow of beverage material therefrom.

In an example of the volumetric filling via dosing block 1525, opening 1530 can provide a dosed beverage material amount therefrom in an amount of about 12 grams, and opening 1530 can provide a dosed beverage material amount therefrom of about 15 grams. The user can select the amount of beverage material desired from a user interface or other input configuration, and the actuator can be configured to move the dosing block in the direction appropriate for the selected beverage dosage amount.

Figure 15C:
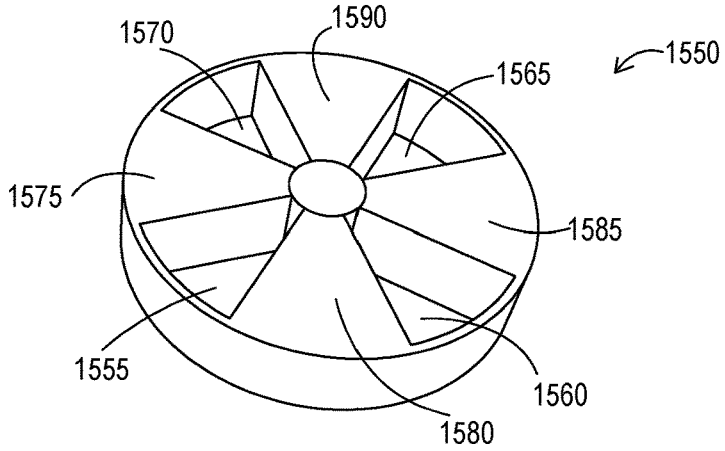

FIG. 15C illustrates a dosing block 1550 having a plurality of volumetric dosing chambers 1555, 1560, 1565, and 1570 and a plurality of solid portions 1575, 1580, 1585 and 1590. Again, the volumetric dosing amounts are determined by both the horizontal surface area and the depth of each chamber. For example, consider differing volumetric dosing amounts in volumetric dosing chambers 1555, 1560, 1565, and 1570 of 1 grams, 2 grams, 3 grams, and 5 grams. If the appropriate amount of beverage material to be dosed into a beverage pod in a dosing operation is 9 grams, the dosing block can be operable to dose beverage material from the 5 gram opening and twice from the 2 gram opening. If the amount of beverage material is 12 grams, the dosing block can be configured to dose two 5 grams amounts, and an additional 2 gram amount. Other dosing block volumetric opening sizes and dosing combinations are suitably selectable and usable in accordance with the present disclosure.

Dosing blocks and the dosing plate can be suitably made from plastic or metallic materials or a combination of both. In some implementations, a coating, such as silicone can be incorporated therein to further reduce the propensity of beverage material to accumulate thereon.

In some implementations, the identity of a selected dosing block engaged with the dosing station can be matched with information associated with the filling device. For example, the user can select a dosing block from a plurality of available dosing blocks, where the volumetric amounts of beverage material dosable therefrom are included in instructions associated with a dosing operation. In one example, the user can input a doser identity (e.g., number, code, or the like) when engaging a dosing block in the dosing station. Alternatively, the beverage material dosing amounts for each selectable dosing block and within each selectable dosing blocks (i.e., the configurations of each opening on each dosing block and the amounts of beverage material dosable therefrom) can automatically be determined and includable in software instructions associated with the filling device. For example, the user can input a desired coffee strength, and the dosing plates can automatically be configured to dose the desired amount therefrom. The user can also be instructed to engage a specific dosing block in the dosing station to achieve a desired beverage flavor and/or strength. The filling device and dosing blocks can be configured with hardware that allows the dosing block to be recognized by the filling device when engaged therein.

Figure 16:
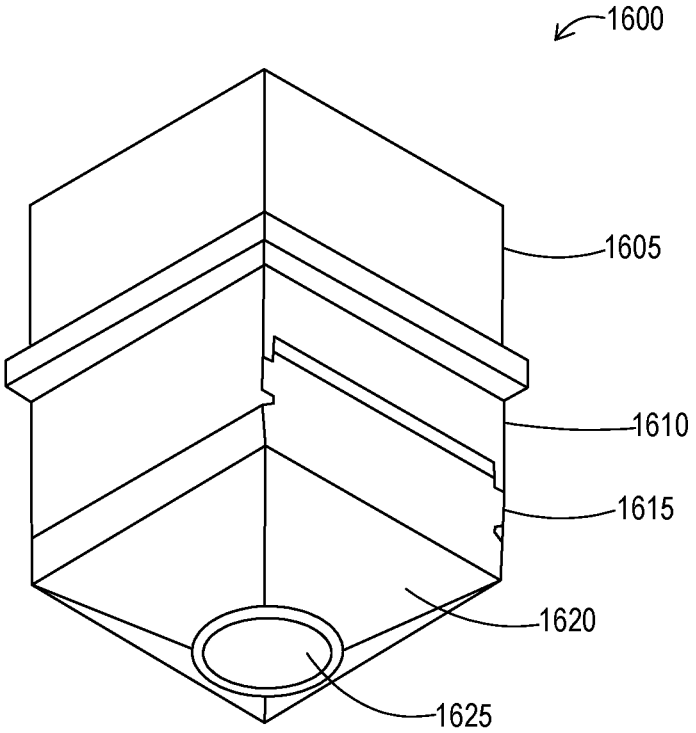
FIG. 16 illustrates beverage material delivery (or dosing) station componentry configuration.

Referring to FIG. 16, beverage material delivery station 1600 is shown from a lower perspective. Walls of the containment hopper 1605 are operationally engaged with the containment hopper base 1610 (or 1205 of FIG. 12) which is, in turn, operationally engaged with beverage dosing component 1615 and beverage material delivery area 1620. A slide gate can be located between the containment hopper base 1610 and beverage dosing component 1615 to prevent the beverage material from the falling out of the containment hopper base 1615 when disconnected from the beverage dosing component 1615. The side gate can include a spring-loaded door of locking mechanism configured to side across the opening in the hopper base 1610 (e.g., opening 1215 in FIG. 12). The sliding gate with a relatively airtight seal will help keep the substance in the container fresh and free from contaminants. Each of these components can be engagably separable with each other and the filling device. In use, the beverage material is delivered from the beverage dosing component 1615 via beverage material exit 1625. As shown, the material delivery area 1620 has sloped sidewalls to assist in beverage material delivery to a suitably aligned beverage pod container when the beverage material delivery station 1600 is operationally engaged with the filling device.

To introduce more beverage material into the beverage pod, about 25% more for example, the user can select the amount of material via a touchpad or by way of providing other instructions to the device as discussed elsewhere herein. In accordance with the volumetric dosing operation herein, the containment hopper opening configuration can then be configurable in response to such user instructions to introduce such 25% greater amount in accordance with the amount of beverage material known to be introduced by each operation. In other words, a user can select an amount of beverage material to be dosed in at least one beverage pod dosing operation, and the selected amount of beverage material can be dosed into the beverage pod container.

The amount of beverage material dosed during each dosing operation can vary according to a number of variables, for example, the identity of the beverage material, the degree of grind of the beverage material, the taste of a user, the volume of beverage desired by the user, among others. In various implementations, the beverage material can be dosed into a dosing staging area configured proximal to the beverage material delivery area. The amount of beverage material dosed from the containment hopper to the dosing staging area can be from at least about 4, or 6, or 8, or 10, or 12, or 16, or 18, or 20 grams of beverage material per beverage pod.

The amount of beverage material dispensed in each dosing operation can vary according to the taste of the user for example. In one implementation, the volumetric dosing operation can be according to the size of openings proximate to a bottom surface of the containment hopper. The openings can be positioned on opposite sides of the bottom portion and sized to dispense different volumes of beverage material as indicated by the sizes of the openings, as well as the speed at which the dosing block moves within the beverage material delivery station to vary the amount of material dosed in an operation. The user can select the amount of beverage material desired in a single operation, for example about 8 or about 10 or about 12 or about 15 grams. In some aspects, the dosing can be varied among individual sizes by selection of a dispensing amount. In further aspects, the dosing block and or dosing plate can be removable and replaceable with different versions to generate differently sized openings for selection of a plurality of beverage material dispensing amounts by a user. The dosing components and the associated dispenser amounts can be detectable by the beverage material filling device, or the user can input information about the bottom portion identity into software associated with the device.

In some aspects, a coffee grinder can be engagably configurable with the beverage material containment hopper. In this regard, a user can introduce the unground beverage material, such as coffee for example, into the grinder. Prior to a filling operation, the user can activate the grinder to provide fresh ground beverage material from the beverage material delivery station for filling of the beverage pod container in a filling operation. Yet further, the beverage material containment hopper can be sized to be configurable as a container for a grinding device that is provided as an auxiliary device to the beverage pod filling device of the present disclosure. In this latter configuration, the beverage material can be ground separately into the containment hopper, with the hopper being engageably attachable to the beverage material filling device. Alternatively, the ready for brewing beverage material can be incorporated into the beverage material containment hopper for use.

In some implementations, a shaking or vibrating or agitating via stiring operation can be incorporated into the dosing operation to facilitate delivery to the container, especially with smaller and finer beverage material that might have a greater propensity to resist flowing. Such shaking or vibration operation can be activated by the operator via button or switch on the filling device, or the functionality can be actuated via software associated with the filling device. In regard, to the latter, the actuation can occur if information about the beverage material indicates that the fineness of the beverage material being dosed may be resistant to efficient feeding into the unfilled beverage pod container. Still further, the shaking or vibration operation can be actuated when a sensor associated with the dosing operation provides information that a beverage material dosing operation is taking longer than expected.

Another dosing operation configuration can incorporate a screw or auger traveling in a walled space. In this regard, the beverage material containment hopper can be in operational engagement with, for example, a screw that is sized to dose the desired amount of beverage material into each beverage pod. In some aspects, the amount of beverage material to be dosed into each beverage pod can be a function of the configuration of the screw (e.g., diameter, blade pitch, angular rotation, etc.) and/or the number of rotations of the screw per beverage material dosing operation. When a signal for a dose of beverage material is generated, a motorized fill screw can be configurable to advance the beverage material. As would be recognized, there is a specific number of screw rotations associated with an amount of beverage material introduced into each beverage pod container. After the amount of beverage material is introduced into a beverage pod container, the screw will stop rotating until a signal is received that a next unfilled beverage pod container is aligned with the beverage material delivery station opening. Such amount of beverage material dispensed by a screw can be readily determined by one of ordinary skill in the art. Yet further, the amount of beverage material added can be determined by a weight detecting sensor that measures the amount of beverage material displaced from the containment hopper into the beverage pod container by a weight differential.

Information about whether the top opening of the unfilled beverage pod container is aligned with the bottom opening of the containment hopper can be generated by one or more sensors associated with the beverage pod filling device, for example. In various implementations, the beverage pod filling device can be configured to lock out the movement of the dosing block and/or to lockout a sliding or blocking door and/or to prevent the screw from turning. A sensor can be configured proximate to the bottom of the beverage material delivery area to ensure that there is alignment with the opening of the unfilled beverage pod container and the opening from which the beverage material is delivered.

Once the beverage material is incorporated into the beverage pod container at the dosing station, the beverage material containment hopper can be substantially prevented from allowing additional beverage material from flowing from the containment hopper until a subsequent dosing operation is commenced. As would be recognized, this will prevent the beverage material from flowing from the containment hopper unless an unfilled beverage pod container is aligned for filling on the indexing belt(s). In this regard, the containment hopper opening can be closed via blocking of the opening by rotation or sliding of the dosing block or the screw can be made to counter rotate or stop to a screw starting configuration. Such closure and counter rotation can be according to a generated signal to the actuators.

Figure 17:
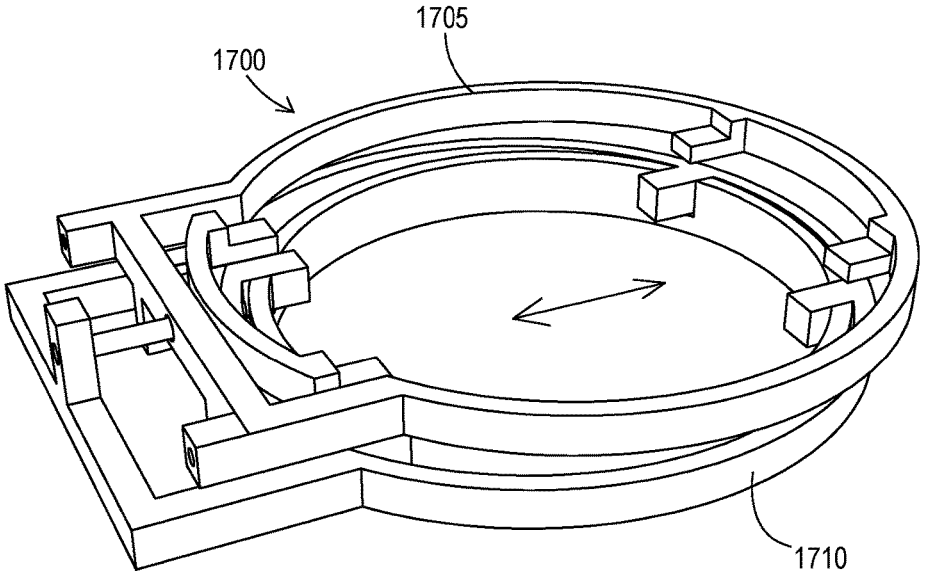
FIG. 17 illustrates a lid separator.

Once the beverage pod container is filled with a desired amount of beverage material, the indexing belt(s) can be configured to index the beverage pod container to the lid delivery station. While the lid delivery station can comprise any suitable configuration, an exemplary implementation of a lid separator is shown in FIG. 17 for a configuration of stacked lids. The illustrated lid delivery component 1700 operates via horizontal reciprocating operation. In this regard, a lower support rim 1705 having a plurality of support fingers positioned on an interior bottom side of upper rim 1710 having a plurality of support fingers. Although four support fingers are shown on rims 1705 and 1710, more or fewer can be used, as long as the lid delivery functionality of the present disclosure is provided. In use, the lids are stacked in the lid delivery component 1700 for storage vertically.

When in use, the lids are stacked vertically in the lid delivery chute. A lid rim can rest on or be supported by rim 1705. When a lid is dropped by operation of the filling device software instructions, the support fingers on rim 1705 will engage the stack of lids. Rim 1705 will retract, allowing the lid to drop, once the lower lid is free of 1705, 1705 will move inwardly. Then 1710 will retract to allow the stack of lids to fall and rest on 1705. The process will then repeat for another lid delivery operation if there is another lid in the stack.

After the lid is delivered from the delivery chute, the filled and lidded beverage pod is indexed along the belt in a timed sequence. While moving along the belt to exit the filling device, pressure can be applied to the top side of the lid by contact of the top side of the filled and lidded beverage pod with a lid fixing component or an interior surface of the filling device, where the lid fixing component or interior surface is opposite the belt(s). For example, a curved spring that is aligned with and curves toward the belt(s) can be used to provide an increasing downward pressure on the lid as the container is moved towards the exit of the filling device. The contact with the lid fixing component or the interior surface of the filling device, when combined with the advancement of the container by the belt(s), ensures that the lid is fully pushed into the beverage pod container so as to be durably fixed within the beverage pod container via the complementary fit thereof. That is, the top surface of the lid will sit above the top surface of the rim before sealing, thus providing an overall height of the lidded but not fully sealed beverage pod container that is greater than the unlidded beverage pod container. When the lidded and filled beverage pod container is advanced on the belt(s), the decrease in overall height (or shortening of a height between the indexing belt and the top of the pod travel path) will result in an attendant reduction in clearance for the lidded beverage pod. As the lidded beverage pod advances along the belt(s) to move toward the end thereof, the lidded beverage pod will be squeezed slightly, which will, in turn, result in the lid being pushed into the beverage pod container to be fully and solidly seated inside and on the top surface therein. Such full seating can result in the sealing of the beverage pod for use.

In a further implementation, a lid pressing station can be included. Such a station can be configured to apply a vertical mechanical pressing operation directly to the top of a lid on an associated beverage pod container, thus ensuring that the lid is tightly seated on, or sealably engaged with, the container. This additional station could be useful if manufacturer tolerances for the cups and lids are such that the lids may need additional force to ensure a tight fit thereof to avoid spillage of the beverage material from the beverage pods during normal handling operations, for example.

In this regard, the small footprint of the filling device can be facilitated by incorporating such a lid fixing step within the container travel path or located proximate to the lid delivery station as the filled and lidded container is indexed along the belt(s) for delivery to the user. For example, the lid fixing area can comprise a belt travel distance positioned after the lid delivery station. The distance can comprise path that incorporates a top interior side of the filling device and a top side of the belt at a location having a clearance between the two sides. The clearance between the top interior side and the top side of the belt at the location after the lid delivery station is less than a clearance between a top interior side of the filling device and the top side of the belt at a location before the lid delivery station. Accordingly, the clearance gets slightly smaller as the filled and lidded container continues to travel along the belt(s), the lid can be pushed farther into the container, if necessary. As would be recognized, the clearance should not be less than the height of the lidded container when the lid is fully seated so as to prevent the container from getting stuck on the belt. In some aspects, the clearance can be adjusted such as by allowing the vertical position of the lid narrowing section to be modified or can be spring loaded or having hydraulic resistance functionality. Use of a curved spring allows the clearance to adjust automatically, with a smaller clearance providing an increased seating force.

Figure 18A:
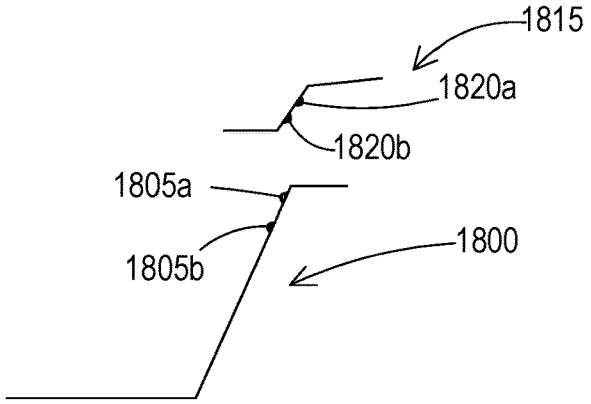
FIGS. 18A, 18B, and 18C illustrate configurations of beverage pod containers and complementary lid configurations.
Figure 18B:
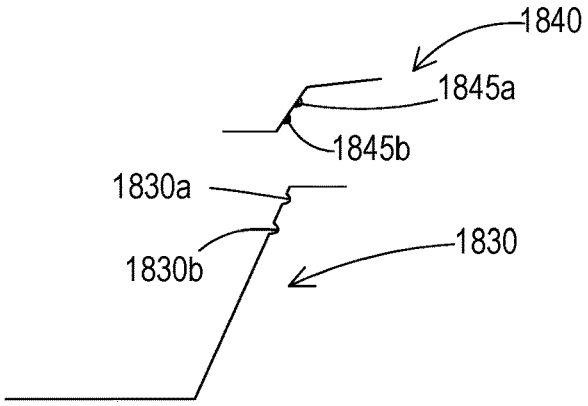
Figure 18C:
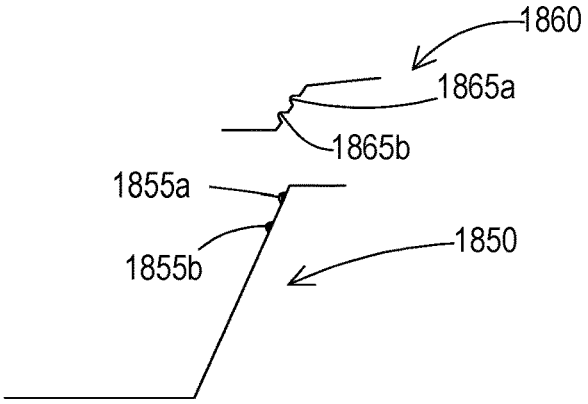

Further beverage pod container configurations are illustrated in FIGS. 18A, 18B and 18C. In 18A, the container 1800 comprises one or more raised areas, here shown as 1805*a* and 1805*b* that are present in the upper rim area of the container 1800, and the associated lid 1815 comprises complementary raised areas 1820*a* and 1820*b*. In FIG. 18B, a container 1830 is shown with grooves or indents 1835*a* and 1835*b* in the upper rim area and the associated lid 1840 has complementary protrusions 1845*a* and 1845*b*. Yet further, FIG. 18C shows a container 1850 having protrusions 1855*a* and 1855*b* along in the upper rim area with the complementary lid 1860 having grooves or indentations 1865*a* and 1865*b* thereon. Such complementary fit configurations have been found useful to enhance sealing of the container and an associated lid, especially when the environment in which the components is of a low enough temperature to cause shrinkage in either the lid or container material. In alternative configurations, either the lid or the container can be segmented in an upper sidewall therein, such as by imparting indentations that are configured to enhance the tightness of the fit between the lid and the associated container. In addition to improving the fit between the container and the associated lid in some circumstances, such protrusion/groove/segment fitting in either or both of the container and the lid has been found to reduce the ability to reuse the componentry, at least because removal of a lid from the pod when a groove and/or protrusion is present can cause deformation of the groove and/or protrusion.

In a further implementation, and in accordance with the beverage pods intended for use with "Nespresso-type" single serve brewers, a beverage material tamping functionality can be incorporated. To suitably generate adequate contact between the beverage material and the hot water to suitably brew a beverage, the beverage material may require pressing into the beverage pod container to compress the coffee in the pod. For such pods, the beverage material delivery station can incorporate a pressing or tamping operation, either proximate to or at a location in the beverage pod travel path prior to the lid delivery station and associated operation.

The beverage material filling device can include at least one control panel (or interface) for user operation. The control panel can suitably be located on the base or other appropriate location of the beverage pod filling device. The control panel provides a user interface with a control system of the filling device. The control panel can be used to control the operation of the beverage pod filling device and provide status indications or messages during the filling process. For example, after turning on the filling device, the user can select the desired operation through control panel and provide the desired quantities of beverage materials from the containment hopper. In some cases, the control panel can provide an indication of the processing time of the beverage pods. The control panel can interact with processing circuitry configured to control the beverage pod filling, sealing, and ejection operation.

Figure 19:
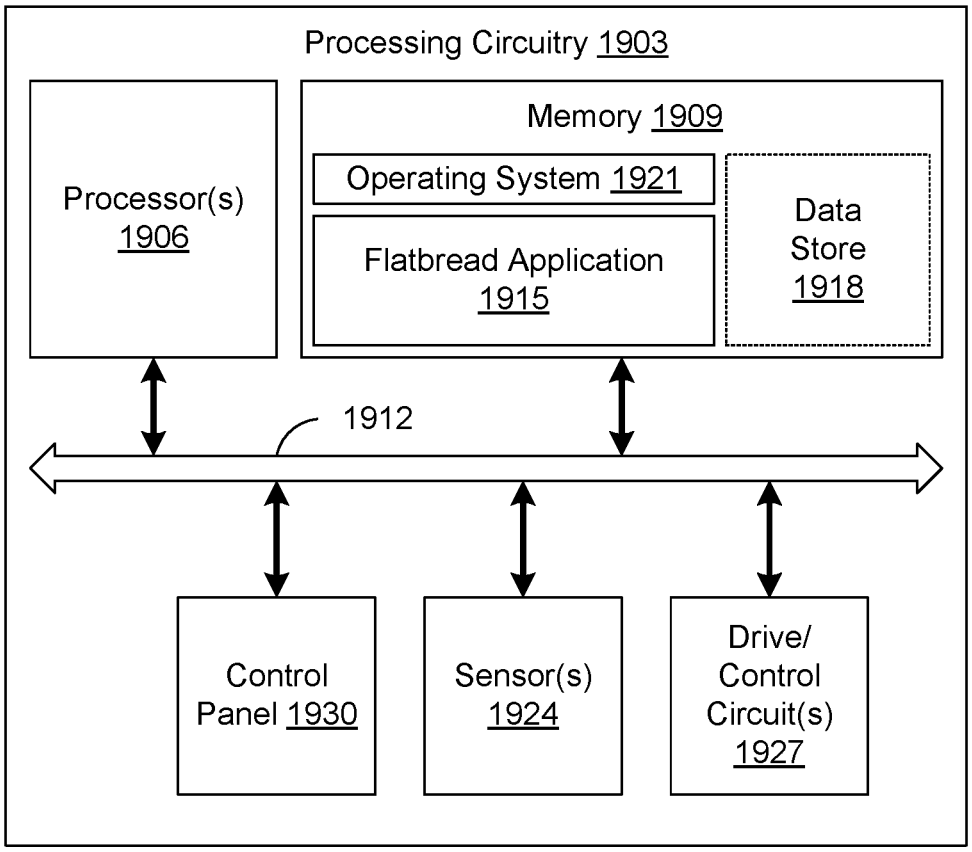
FIG. 19 illustrates an exemplary configuration of processing circuitry that can be utilized in a beverage pod filling device.

Referring to FIG. 19, shown is an example of processing circuitry 1903 that can be utilized in a beverage pod filling device. The processing circuitry 1900 can include at least one processor circuit, for example, having a processor 1906 and a memory 1909, both of which are coupled to a local interface 1912. The local interface 1912 may comprise, for example, a data bus with an accompanying address/control bus or other bus structure as can be appreciated. Stored in the memory 1909 are both data and several components that are executable by the processor 1906. In particular, stored in the memory 1909 and executable by the processor 1906 are a beverage material filling application 1915 and potentially other applications.

Also stored in the memory 1909 may be a data store 1918 and other data. The data stored in the data store 1918, for example, is associated with the operation of the beverage material filling device. For example, the data store 1918 can include beverage material identities, operational parameters, user preference setting parameters, and other data or information as can be understood. In addition, an operating system 1921 may be stored in the memory 1909 and executable by the processor 1906. The processing circuitry 1903 can monitor the system conditions through one or more sensor(s) 1924 (e.g., temperature sensor(s), proximity sensor(s), displacement sensor(s), pressure/force sensor(s), etc.) and provide control signals to various actuator and/or control circuitry 1927 as has been described.

The processing circuitry 1903 can interface with a user of the beverage pod filling device through the control panel (or interface) 1930 to accept inputs and provide outputs of the beverage pod filling machine. To this end, the control panel 1930 can comprise a display configured to indicate, e.g., system status and/or prompt for user inputs. The control panel 1930 can also include one or more buttons or keypad to communicate with the user, or can include a touch screen for user inputs. The control panel 1930 can be configured to allow for various operational inputs and outputs such as, but not limited to, power ON/OFF, start/stop, "cycle finished," audible signals, batch size (e.g., 1 pod, 2 pod, 3 pods, etc. and/or number of beverage pods and, in some aspects, desired amount of beverage material dosed into each pod. A separate power switch can be located at another location on the beverage pod filling device to isolate the power supply from the other circuitry in the filling device.

The processing circuitry can also be configured to allow the beverage pod filling device to communicate with an external device though a communication link or other network connection. For example, the beverage pod filling device can come with a smartphone app that connects to the machine via Bluetooth®, WiFi, or other appropriate communication link. The smartphone app can allow the user to control several aspects of the flatbread making process such as, but not limited to, the identification of the beverage material, amount of beverage material dosed in each pod, etc. With this, a user can define their own custom beverage pod contents, and get it right every single time with user's choice of ingredients. They can even use the app with other beverage pod filling machines when visiting friends, for example. The ability to communicate through the communication link or network connection also allows for downloading and/or updating the beverage machine firmware and/or software (e.g., through the smartphone app), and upload and/or transfer machine diagnostic data to support resources such as a website.

The beverage pod filling device can provide a sealed beverage pod that can be used for beverage material delivery from a single serving brewer device. In one or more aspects, the beverage pod comprises a pod container having an interior sidewall tapering between an opening and a bottom of the pod container; and a pod lid comprising an outer sidewall, where the outer sidewall comprises a fastening mechanism configured to sealably engage with a complementary fastening mechanism on an upper portion of the interior sidewall of the pod container adjacent to the opening. In various aspects, the fastening mechanism can comprise a protrusion extending around the outer sidewall of the pod lid. The complementary fastening mechanism can comprise a complementary protrusion extending around the upper portion of the interior sidewall, wherein the protrusion extending around the outer sidewall sealably engages with a lower edge of the complementary protrusion when the pod lid is inserted inside the upper portion of the interior sidewall. The complementary fastening mechanism can comprise a complementary groove or indentation extending around the upper portion of the interior sidewall, wherein the protrusion extending around the outer sidewall sealably engages with complementary groove or indentation when the pod lid is inserted inside the upper portion of the interior sidewall. In some aspects, the fastening mechanism can comprise a second protrusion extending around the outer sidewall of the pod lid, the protrusions extending around the outer sidewall being substantially parallel. The complementary fastening mechanism can comprise a first complementary protrusion extending around the upper portion of the interior sidewall and a second complementary protrusion extending around the upper portion of the interior sidewall, wherein the protrusions extending around the outer sidewall sealably engage with the first and second complementary protrusions when the pod lid is inserted inside the upper portion of the interior sidewall. The second protrusion can extend around the outer sidewall sealably engages with a lower edge of the second complementary protrusion when the pod lid is inserted inside the upper portion of the interior sidewall. In various aspects, the complementary fastening mechanism can comprise a first complementary groove or indentation extending around the upper portion of the interior sidewall and a second complementary groove or indentation extending around the upper portion of the interior sidewall, wherein the protrusions extending around the outer sidewall sealably engage with the first and second complementary grooves or indentations when the pod lid is inserted inside the upper portion of the interior sidewall.

In one or more aspects, the fastening mechanism can comprise a groove or indentation extending around the outer sidewall of the pod lid. The complementary fastening mechanism can comprise a complementary protrusion extending around the upper portion of the interior sidewall, wherein the protrusion extending around the outer sidewall sealably engages with the groove or indentation when the pod lid is inserted inside the upper portion of the interior sidewall. The fastening mechanism can comprise a second groove or indentation extending around the outer sidewall of the pod lid, the grooves or indentations extending around the outer sidewall being substantially parallel. The complementary fastening mechanism can comprise a first complementary protrusion extending around the upper portion of the interior sidewall and a second complementary protrusion extending around the upper portion of the interior sidewall, wherein the grooves or indentations extending around the outer sidewall sealably engage with the first and second complementary protrusions when the pod lid is inserted inside the upper portion of the interior sidewall. In various aspects, the pod container can comprise an adhesive on an upper surface of a rim of the pod container or the pod lid can comprise an adhesive on a lower surface of a rim of the pod lid. The adhesive can be configured to provide a seal between the rim of the pod container and the rim of the pod lid when the pod lid is sealably engaged with the pod container.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

What is claimed is:

1. A beverage material filling device for filling a beverage pod comprising a beverage pod container and a beverage pod lid, the beverage material filling device comprising:

a belt system having a first end and a second end, and being engaged with a belt activator, thereby configuring the belt system to index along a beverage material filling device path;

a beverage pod container delivery station configured to hold a plurality of beverage pod containers in a nested configuration, wherein the beverage pod container delivery station is configured to deliver one beverage pod container at a time to the belt system in a delivery operation proximate to the first end of the belt system;

a beverage material delivery station configured to deliver beverage material to the beverage pod container when aligned with a beverage material exit at a bottom side of the beverage material delivery station, wherein the beverage pod container becomes aligned with the beverage material exit when the beverage pod container is indexed from the beverage pod container delivery station to the beverage material delivery station by the belt system; and a beverage pod lid delivery station configured to hold a plurality of beverage pod lids in a nested configuration, wherein the beverage pod lid delivery station is configured to deliver one beverage pod lid at a time to an interior opening of the beverage pod container when aligned with a lid delivery chute, wherein the beverage pod container becomes aligned with the lid delivery chute when the beverage pod container is indexed from the beverage material delivery station to the beverage pod lid delivery station by the belt system.

2. The beverage material filling device of claim 1, wherein the beverage pod container delivery station comprises a container delivery chute in operational engagement with a container separator, the container delivery chute configured to accept a nested stack of beverage pod containers.

3. The beverage material filling device of claim 2, wherein the container separator comprises a plurality of cams rotationally engagable with a rim of a lowest beverage pod container in the nested stack of beverage pod containers in the delivery chute.

4. The beverage material filling device of claim 3, wherein each of the plurality of cams comprises a lower support finger configured to support the nested stack of beverage pod containers when that cam is in a first position and a tapered portion opposite the lower support finger, where the tapered portion is configured to separate the one beverage pod container from the nested stack of beverage pod containers as that cam rotates to a second position.

5. The beverage material filling device of claim 4, wherein the lower support fingers of the plurality of cams are engaged with a lower surface of the rim of the lowest beverage pod container when in the first position.

6. The beverage material filling device of claim 4, wherein the tapered portions of the plurality of cams apply a downward force to an upper surface of the rim of the lowest beverage pod container, or can apply an upward force to a lower surface of a rim of a next beverage pod container that is nested in the lowest beverage pod container, when rotating to the second position.

7. The beverage material filling device of claim 4, wherein a next beverage pod container is nested in the lowest beverage pod container, and each of the plurality of cams comprise a top surface that engages with a rim of the next beverage pod container when that cam is rotating to the second position.

8. The beverage material filling device of claim 7, wherein the lower support fingers of the plurality of cams are positioned under the rim of the next beverage pod container when the plurality of cams are rotated back to the first position.

9. The beverage material filling device of claim 1, wherein the beverage material delivery station comprises a containment hopper having a bottom opening, wherein the bottom opening is in operational engagement with at least one opening in a dosing plate.

10. The beverage material filling device of claim 9, wherein a dosing block is rotationally engaged with the containment hopper and the dosing plate.

11. The beverage material filling device of claim 10, wherein the dosing block comprises at least one volumetric beverage material loading chamber.

12. The beverage material filling device of claim 10, wherein the dosing block comprises two or more volumetric loading chambers.

13. The beverage material filling device of claim 9, wherein a bottom of the dosing plate comprises a plurality of grooves configured to substantially prevent accumulation of beverage material between the dosing plate and a dosing plate contacting side of the dosing block and a discharge port.

14. The beverage material filling device of claim 9, wherein the dosing block is configured to deliver from about 2 grams to about 15 grams of the beverage material to the beverage pod container when aligned with the beverage material exit of the beverage material delivery station.

15. The beverage material filling device of claim 1, wherein the beverage pod lid delivery station comprises the lid delivery chute in operational engagement with a lid separator.

16. The beverage material filling device of claim 1, further comprising a lid fixing area configured to sealably fix the beverage pod lid in the interior opening of the beverage container as the beverage pod lid and beverage pod container are indexed to an exit location proximate to the second end of the belt.

17. The beverage material filling device of claim 16, wherein the lid fixing area comprises a belt travel distance positioned between the beverage pod lid delivery station and the exit location, the belt travel distance comprising a top interior side of the beverage material filling device and a top side of the belt system, wherein a clearance between the top interior side and the top side of the belt system decreases from a location after the beverage pod lid delivery station to a location before the exit location.

18. The beverage material filling device of claim 16, wherein the lid fixing area comprises a lid fixing component configured to apply a sealing force to the beverage pod lid in the interior opening of the beverage container as the beverage pod lid and beverage pod container are advanced from the beverage pod lid delivery station to the exit location.

19. The beverage material filling device of claim 1, wherein the belt system comprises two belts extending substantially in parallel from the first end to the second end, the two belts coupled at the first end to a common shaft driven by the belt activator.

20. The beverage material filling device of claim 1, wherein the belt activator comprises a motor, and rotation of the motor by a fixed number of turns advances the beverage pod container from the beverage pod container delivery station to alignment with the beverage material exit of the beverage material delivery station.

21. The beverage material filling device of claim 20, wherein further rotation of the motor by the fixed number of turns advances the beverage pod container from the beverage material delivery station to alignment with the lid delivery chute of the beverage pod lid delivery station.

* * * * *